US011648769B2

(12) United States Patent
Niizuma

(10) Patent No.: US 11,648,769 B2
(45) Date of Patent: May 16, 2023

(54) INKJET RECORDING METHOD AND INKJET RECORDING APPARATUS

(71) Applicant: Konica Minolta, Inc., Tokyo (JP)

(72) Inventor: Naoto Niizuma, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/226,773

(22) Filed: Apr. 9, 2021

(65) Prior Publication Data

US 2021/0354445 A1 Nov. 18, 2021

(30) Foreign Application Priority Data

May 12, 2020 (JP) ..... JP2020-083699

(51) Int. Cl.
*B41J 2/045* (2006.01)
*B41J 2/21* (2006.01)

(52) U.S. Cl.
CPC ..... *B41J 2/0456* (2013.01); *B41J 2/04586* (2013.01); *B41J 2/2132* (2013.01)

(58) Field of Classification Search
CPC ..... B41J 2/0456; B41J 2/04586; B41J 2/2132
See application file for complete search history.

(56) References Cited

U.S. PATENT DOCUMENTS

2016/0243848 A1* 8/2016 Komamiya ..... G06K 15/1848
2020/0039232 A1 2/2020 Asakawa et al.

FOREIGN PATENT DOCUMENTS

JP H08-52867 A 2/1996
JP 2002-321349 A 11/2002
JP 4742637 B2 8/2011

OTHER PUBLICATIONS

EPO, Extended European Search Report for the related European Patent Application No. 21167638.2, dated Sep. 30, 2021.
Office Action for the related Chinese Patent Application No. 202110514528.0 dated Jul. 11, 2022, with English translation.
Office Action/Search Report dated Jan. 19, 2023 for the corresponding Chinese Application No. 202110514528.0, with English translation.

* cited by examiner

*Primary Examiner* — Thinh H Nguyen
(74) *Attorney, Agent, or Firm* — Lucas & Mercanti, LLP

(57) ABSTRACT

Provided is an ink jet recording method in which an image is formed by applying an ink containing a coloring material and a processing liquid containing a flocculant to a surface of a recording medium by a droplet discharge device to coalescence, wherein an application amount of the processing liquid is changed in accordance with an application amount of the ink for each unit area, and is controlled to be 5 g/m$^2$ or less in all of the unit areas in which the images are formed, and when the image is formed in a plurality of printing passes, an average value of the application amounts of the processing liquid in each printing pass in the unit areas in which the application amount of the processing liquid is 0.8 g/m$^2$ or more is controlled so that a deviation when compared between the printing passes is within ±30%.

14 Claims, 9 Drawing Sheets

INKJET RECORDING METHOD AND INKJET RECORDING APPARATUS

CROSS-REFERENCE TO RELATED APPLICATION

The entire disclosure of Japanese Patent Application No. 2020-083699 filed on May 12, 2020 is incorporated herein by reference in its entirety.

BACKGROUND

Technological Field

The present invention relates to an inkjet recording method and an inkjet recording apparatus. More specifically, the present invention relates to an inkjet recording method and an inkjet recording apparatus in which image quality is improved in an image formed on a recording medium, in particular, on a recording medium of low absorption or non-absorption in a two-liquid type inkjet recording method.

Description of the Related Art

In the inkjet recording method, it is known that image quality is deteriorated due to a liquid deviation phenomenon in which dropped inks coalescence on a recording medium or color bleeding in which bleeding occurs between different colors. As a solution to these problems, a two-liquid type inkjet recording method is disclosed in which, from an inkjet head (hereinafter, simply referred to as a "head"), a processing liquid for agglomerating a coloring material in the ink is ejected separately from the ink, and the processing liquid is merged with the ink on the recording medium, thereby fixing the ink to the recording medium satisfactorily (for example, refer to Patent Document 1: JP-A 8-52867).

Further, in an inkjet recording method of a two-liquid type system, in order to achieve both suppressing of curl and cockling of paper, which is a recording medium, and image quality, a means for varying the amount of the processing liquid discharged from the head according to the application amount of the ink is disclosed (for example, refer to Patent Document 2: JP-A 2002-321349; and Patent Document 3: Japanese Patent No. 4742637).

However, in the inkjet recording method of the two-liquid type system, if the application amount of the processing liquid is not optimally controlled with respect to the application amount of the ink, there is a problem of deterioration of the image quality due to cracking of the ink coating film in a region where the application amount of the ink is large. In addition, in a region where the ink application amount is small, there is a problem that image quality is lowered due to unevenness of the dropped dot shape or appearance of a granular feeling (granularity) due to liquid deviation. Further, the color bleeding problem has not been sufficiently solved even in the two-liquid type inkjet recording method.

In particular, when a low-absorbent or non-absorbent recording medium such as a plastic base material, a metal base material, or a leather base material is used as a recording medium, the above influence appears remarkably, and a conventional two-liquid type inkjet recording method is insufficient as a means for solving these effects.

SUMMARY

The present invention has been made in view of the above problems and status, and an object of the present invention is to provide an inkjet recording method and an inkjet recording apparatus in which the quality of an image is improved in an image formed on a recording medium, in particular, on a recording medium of low absorption or non-absorption in a two-liquid type inkjet recording method.

In order to solve the above-mentioned problems, the present inventor has found the following in the process of examining the causes of the above-mentioned problems. That is an inkjet recording method for forming an image by applying an ink containing at least a coloring material and a processing liquid containing at least a flocculant to a surface of a recording medium by a droplet discharge device, respectively, to coalescence the ink and the processing liquid, wherein an amount of application of the processing liquid is controlled to be changed according to an amount of application of the ink, and the amount of application of the processing liquid in a unit area is controlled to be equal to or less than a specific amount for each unit area in which the image is formed, and in the unit area in which the amount of application of the processing liquid is equal to or greater than a specific amount when the image is formed in a plurality of printing passes, an average value of the amounts of application of the processing liquid in the unit area in each printing pass is controlled to be within a specific ratio when the deviation of the amounts of application of the processing liquid in the unit area in each printing pass is compared between the printing passes. Thus, it has been found that a high-quality image was formed, and thus the present invention has been achieved. In other words, the above problem according to the present invention is solved by the following means.

To achieve at least one of the abovementioned objects, according to an aspect of the present invention, an inkjet recording method that reflects an aspect of the present invention is as follows.

An inkjet recording method for forming an image by applying an ink containing at least a coloring material and a processing liquid containing at least a flocculant to a surface of a recording medium by a droplet discharge device, respectively, to coalescence the ink and the processing liquid, wherein an application amount of the processing liquid is changed in accordance with an application amount of the ink for each unit area in which the image is formed, and the application amount of the processing liquid is controlled to be equal to or less than 5 $g/m^2$ in all of the unit areas; and when the image is formed in a plurality of printing passes, in the unit area in which the application amount of the processing liquid is equal to or more than 0.8 $g/m^2$, an average value of the application amounts of the processing liquid in the unit area in each printing pass is controlled so that a deviation when compared between the printing passes is within ±30%.

An inkjet recording apparatus that reflects another aspect of the present invention is as follows.

An inkjet recording apparatus using an ink containing at least a coloring material and a processing liquid containing at least a flocculant, comprising a droplet discharge device having one or more discharge ports for discharging the ink and one or more discharge ports for discharging the processing liquid for forming an image by applying droplets of the ink and droplets of the processing liquid to a surface of a recording medium from the droplet discharge device to coalescence the droplets of the ink and the droplets of the processing liquid, wherein an application amount of the processing liquid is changed in accordance with an application amount of the ink for each unit area in which the image is formed, and the application amount of the processing liquid is controlled to be equal to or less than 5 g/m$^2$ in all of the unit areas, and when the image is formed in a plurality of printing passes, in the unit area in which the application amount of the processing liquid is equal to or more than 0.8 g/m$^2$, an average value of the application amounts of the processing liquid in the unit area in each printing pass is controlled so that a deviation when compared between the printing passes is within ±30%.

According to the above-mentioned means of the present invention, it is possible to provide an inkjet recording method and an inkjet recording apparatus in which the quality of an image is improved in an image formed on a recording medium, in particular, on a recording medium of low absorption or non-absorption in a two-liquid type inkjet recording method. The expression mechanism or action mechanism of the effect of the present invention is not clarified, but is inferred as follows.

As described above, in the inkjet recording method of the two-liquid type system, when the application amount of the processing liquid is not optimally controlled with respect to the application amount of the ink, not only cracks and granularity are generated in the ink coating film, but also color bleeding is generated.

The present inventors have found that, in an image forming region by an inkjet recording method, by controlling so as to change an amount of application of a processing liquid in accordance with an amount of application of an ink for each unit area in which an image is formed, an expression of a granularity may be suppressed in a region in which an ink application amount is small, and a crack may be suppressed in an ink coating film by controlling so that an amount of application of a processing liquid is equal to or less than 5 g/m$^2$ in an entire unit area in which an image is formed.

In addition, it has been found that the generation of color bleeding is suppressed by controlling the ratio of the application amount of the processing liquid between a plurality of printing passes to be substantially equal, specifically, by controlling the average value of the application amounts of the processing liquid in the unit area in which the application amount of the processing liquid is equal to or more than 0.8 g/m$^2$ in each printing pass so that a deviation when compared between the printing passes is within ±30%.

As described above, according to the present invention, in the two-liquid type inkjet recording method, it is possible to provide an inkjet recording method and an inkjet recording apparatus in which the quality of an image is improved by suppressing the occurrence of cracks, graininess, and color bleeding in an ink coating film with respect to an image formed on a recording medium, in particular, on a low absorption or non-absorption recording medium.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
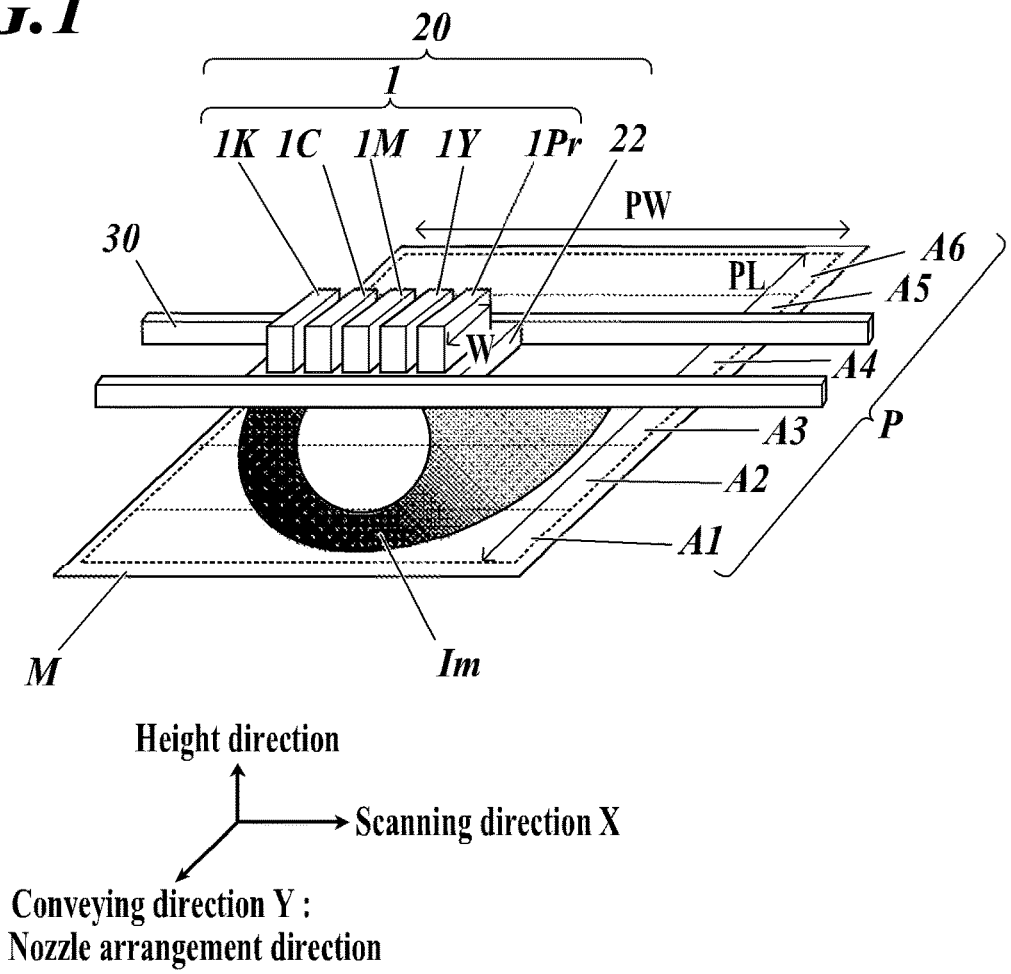
FIG. 1 is a diagram schematically illustrating an example of a main part of a two-liquid type inkjet recording apparatus to which the present invention is applicable.

Hereinafter, one or more embodiments of the present invention will be described. However, the scope of the invention is not limited to the disclosed embodiments.

The inkjet recording method of the present invention (hereinafter, also referred to simply as a "recording method") is a recording method for forming an image by applying an ink containing at least a coloring material and a processing liquid containing at least a flocculant to a surface of a recording medium by a droplet discharge device, respectively, to coalescence the ink and the processing liquid, and is characterized in that the relationship between the application amount of the ink and the application amount of the processing liquid is controlled as described in the conditions (1) and (2) below.

(1) The application amount of the processing liquid is changed in accordance with the application amount of the inks for each unit area in which the image is formed, and the application amount of the processing liquid is controlled to be equal to or less than 5 $g/m^2$ in all of the unit areas.

(2) When an image is formed in a plurality of printing passes, in a unit area in which an application amount of the processing liquid is equal to or more than 0.8 $g/m^2$, an average value of the application amounts of the processing liquid in the unit area in each printing pass is controlled so that a deviation when compared between the printing passes is within ±30%.

This feature is a technical feature common to each of the following embodiments of the recording method of the present invention.

As an embodiment of the recording method of the present invention, from the viewpoint of expressing the effect of the present invention, in the relationship between the application amount of the ink and the application amount of the processing liquid, it is preferable to further control the application amount of the processing liquid in all of the unit areas in which the images are formed so as to be 100% or less of the application amount of the ink, and to control the application amount of the processing liquid to the unit area to be 45% or less of the application amount of the ink when the application amount of the ink is 9 $g/m^2$ or more in the unit area.

As an embodiment of the recording method of the present invention, from the viewpoint of expressing the effect of the present invention, it is preferable that, in the relationship between the application amount of the ink and the application amount of the processing liquid, it is further controlled so that the processing liquid is not applied to the unit area when the application amount of the ink is less than or equal to a 1.0 $g/m^2$ in the unit area where the image is formed. Thus, it is possible to obtain an effect of further suppressing the development of a granularity in a region having a small amount of the ink applied.

As an embodiment of the recording method of the present invention, from the viewpoint of expressing the effect of the present invention, it is preferable that the processing liquid is applied by an error diffusion method. As a result, an effect of improving the uniformity of the solid image may be obtained.

In an embodiment of the recording method of the present invention, from the viewpoint of expressing the effect of the present invention, when the formation of an image on the surface of the recording medium is performed so that print areas corresponding to the print width of the droplet discharge device are arranged in parallel, it is preferable to relatively increase the application amount of the processing liquid in the vicinity of the boundary between the print areas. As a result, an effect of suppressing the occurrence of ink bleeding in the vicinity of the boundary of the printing region may be obtained.

As an embodiment of the recording method of the present invention, from the viewpoint of expressing the effect of the present invention, it is preferable that the landing time of the processing liquid and the ink is 0.6 seconds or less, respectively. As a result, an effect of improving the stability of the quality of the image may be obtained.

As an embodiment of the recording method of the present invention, from the viewpoint of expressing the effect of the present invention, it is preferable that the processing liquid is applied to the image forming region on which the image is formed and the peripheral region of the image forming region, and the application amount of the processing liquid to the peripheral region of the image forming region is controlled so as to be the same as the application amount of the processing liquid at an end portion of the image forming region. As a result, an effect of suppressing the occurrence of ink bleeding in the vicinity of the boundary between the image forming region and the peripheral region may be obtained.

As an embodiment of the recording method of the present invention, from the viewpoint of expressing the effect of the present invention, when the application amount of the ink at the end portion of the image forming region is equal to or less than 15 $g/m^2$, it is preferable to control so that the processing liquid is not applied to a peripheral region of the end portion. As a result, an effect of improving the sharpness of the region where the ink application amount is relatively small at the end portion of the image forming region may be obtained.

As an embodiment of the recording method of the present invention, from the viewpoint of expressing the effect of the present invention, when the processing liquid is also applied to the peripheral region of the image forming region, it is preferable that the peripheral region is a region of 0.030 to 0.150 mm outside of the outer periphery starting from the outer periphery of the image forming region. As a result, an effect of improving the sharpness at the end portion of the image to be formed may be obtained.

As an embodiment of the recording method of the present invention, from the viewpoint of expressing the effect of the present invention, it is preferable that the static surface tension of the processing liquid is smaller than the static surface tension of the ink at 25° C. As a result, an effect of improving the sharpness at the end portion of the image to be formed may be obtained.

As an embodiment of the recording method of the present invention, from the viewpoint of expressing the effect of the present invention, it is preferable that the processing liquid contains a polyvalent metal salt or a solution cationic polymer as the flocculant, and that the processing liquid does not contain resin fine particles.

As an embodiment of the recording method of the present invention, from the viewpoint of expressing the effect of the present invention, it is preferable that the dynamic surface tension of the processing liquid is 35 mN/m or less at 25° C. and 50 ms.

An inkjet recording apparatus (hereinafter, also simply referred to as a "recording apparatus") of the present invention uses an ink containing at least a coloring material, and a processing liquid containing at least a flocculant. This recording apparatus comprises a droplet discharge device having one or more discharge ports for discharging the ink and one or more discharge ports for discharging the processing liquid. This recording apparatus forms an image by applying the droplets of the ink and the droplets of the processing liquid from the droplet discharge device to the surface of the recording medium to coalescence them, provided that a relationship between an application amount of the ink and an application amount of the processing liquid is controlled as described in the conditions (1) and (2).

As an embodiment of the recording apparatus of the present invention, from the viewpoint of expressing the effect of the present invention, in the relationship between the application amount of the ink and the application amount of the processing liquid, it is preferable to further control the application amount of the processing liquid in all of the unit areas in which the images are formed so as to be 100% or less of the application amount of the ink, and to control the application amount of the processing liquid to the unit area to be 45% or less of the application amount of the ink when the application amount of the ink is 9 $g/m^2$ or more in the unit area.

As an embodiment of the recording apparatus of the present invention, from the viewpoint of expressing the effect of the present invention, it is preferable that the processing liquid is applied to the image forming region on which the image is formed and to the peripheral region of the image forming region, and the application amount of the processing liquid to the peripheral region of the image forming region is controlled so as to be the same as the application amount of the processing liquid at the end portion of the image forming region.

Hereinafter, the present invention and the constitution elements thereof, as well as configurations and embodiments to carry out the present invention, will be detailed in the following. In the present description, when two figures are used to indicate a range of value before and after "to", these figures are included in the range as a lowest limit value and an upper limit value.

[Recording Method of the Present Invention]

The recording method of the present invention is a recording method for forming an image by applying an ink containing at least a coloring material and a processing liquid containing at least a flocculant to a surface of a recording medium by a droplet discharge device, respectively, so that the relationship between the application amount of the ink and the application amount of the processing liquid is controlled as described in the following conditions (1) and (2).

(1) The application amount of the processing liquid is changed in accordance with the application amount of the ink for each unit area in which the image is formed, and the application amount of the processing liquid is controlled to be equal to or less than 5 $g/m^2$ in all of the unit areas.

(2) When the image is formed in a plurality of printing passes, in the unit area in which the application amount of the processing liquid is equal to or more than 0.8 $g/m^2$, an average value of the application amounts of the processing liquid in the unit area in each printing pass is controlled so that a deviation when compared between the printing passes is within ±30%.

Figure 2:
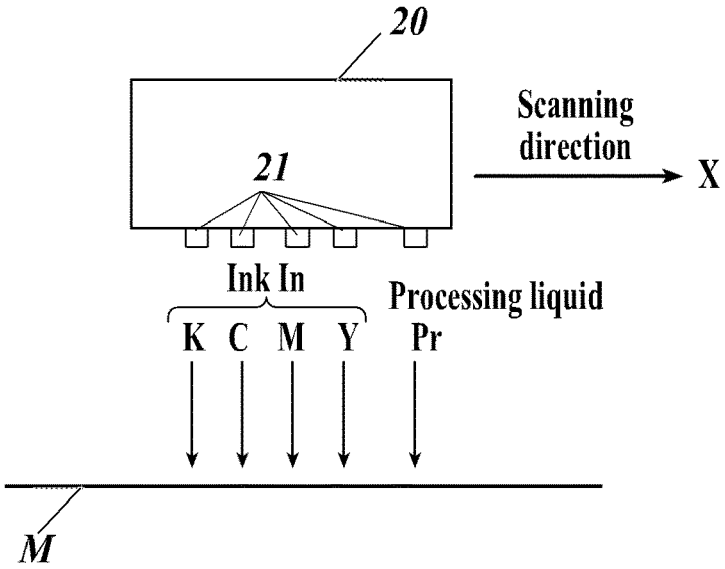
FIG. 2 is a diagram schematically showing a state in which an ink and a processing liquid are applied from a droplet discharge device to a surface of a recording medium by the method shown in FIG. 1.

The recording method of the present invention is a so-called two-liquid type recording method in which an image is formed by applying an ink and a processing liquid to a surface of a recording medium by a droplet discharge device, respectively, and bringing them together. An example of a main part of a two-liquid type inkjet recording apparatus (scanning method) to which the present invention is applicable is schematically shown in FIG. 1. FIG. 2 schematically shows a state in which the ink and the processing liquid are applied from the droplet discharge device to the surface of the recording medium by the apparatus shown in FIG. 1. Hereinafter, the recording method of the present invention will be described by taking the scanning method as an example with reference to FIG. 1 and FIG. 2, but the recording method of the present invention is not limited thereto. The present invention is also applicable to an inkjet recording apparatus of a line system, which will be described later.

In the recording method using the recording apparatus shown in FIG. 1, an image is formed as shown in FIG. 2 by moving the droplet discharge device 20 on the recording medium M in the scanning direction X (hereinafter also referred to as "X direction") while discharging the inks Y, M, C, and K (yellow, magenta, cyan, and black) of the respective colors and the processing liquid Pr. In the recording apparatus shown in FIG. 1, the recording medium M is sequentially conveyed in a direction Y orthogonal to the scanning direction X (hereinafter also referred to as "conveying direction Y" or "Y direction") by a conveying device (not shown) so that an image may be formed on substantially the entire surface (image forming surface) of the recording medium M.

The droplet discharge device 20 includes a head 1Pr for a processing liquid, heads 1Y, 1M, 1C, and 1K corresponding to inks of each color (hereinafter, these are collectively referred to as "head unit 1"), and it has a carriage 22 for arranging and holding these heads along the scanning direction X.

A plurality of nozzles are arranged on the surface (nozzle surface) of each head facing the surface of the recording medium M along the direction Y orthogonal to the scanning direction X. Minute droplets are ejected from these nozzles by appropriately applying pressure to the ink and the processing liquid. The droplet discharge device 20 is supported in a state in which the nozzle surface of the head unit 1 is spaced a predetermined distance from the surface in a direction (height direction) perpendicular to the surface of the recording medium M.

The droplet discharge device 20 is scanned in the scanning direction X by the scanning unit 30. The scanning unit 30 includes, for example, a rail for supporting the carriage 22 in a state where the nozzle surface is spaced apart from the surface of the recording medium M by the predetermined distance described above in the height direction, so that the carriage 22 may be moved along a rail extending along the scanning direction X.

FIG. 1 shows the entire print area P as a range in which an image may be formed on the recording medium M by scanning the droplet discharge device 20 in the X direction and transporting the recording medium M in the Y direction. It is indicated that the length of the entire print area P in the X direction is the print area width PW, and it is indicated that the length in the Y direction is the print area length PL.

When the droplet discharge device 20 moves once in the scanning direction X, the inks Y, M, C, and K (hereinafter collectively referred to as "In") and the processing liquid Pr are applied in the region of the width PW of the printing region in the direction Y orthogonal to the scanning direction X of the head unit 1 with respect to the width PW of the entire print area P. In the recording method of the scanning method as shown in FIG. 1, a plurality of printing passes are performed in the same area and a desired image is finally formed on the recording medium M by performing a plurality of printing passes in the same area with the operation of applying the ink In and the processing liquid Pr to the recording medium M by one movement of the droplet discharge device 20 in the scanning direction X as a single printing pass.

Here, in the recording apparatus, the presence or absence of ink application and the amount of ink application are determined for each pixel area by the control unit according to the image data of the document, and the image is formed by applying ink to the surface of the recording medium M on the basis of the determination by the droplet discharge device. In some cases, image formation on the recording medium M is completed in one printing pass, but in the case of forming an image having a high resolution (dpi), image formation on the recording medium M is performed by decomposing the image and performing a plurality of printing passes.

In FIG. 1, the region to which the ink and the processing liquid are applied by one movement of the droplet discharge device 20 is an area (hereinafter also referred to as "print area A") obtained by multiplying the print area width PW in the scanning direction X by the width W in the direction Y orthogonal to the scanning direction X of the head unit 1 (hereinafter also referred to as "width W of the head unit 1").

The entire print area P is an aggregate of the print areas A. The number of print areas A constituting the entire print area P is represented by a value obtained by dividing the print area length PL by the width W of the head unit 1. For example, in the case of the recording medium M shown in FIG. 1, the number of the print areas A constituting the entire print area P is 6, and the print areas A1, A2, A3, A4, A5, and A6 are arranged in parallel in order from the front to the back of the recording medium M to constitute the entire print area P.

In FIG. 1, an image has already been formed in the print areas A1, A2, and A3 in the entire print area P. In the printing area A4, an image is being formed by the droplet discharge device 20, and after the image formation in the printing area A4 is completed, images are sequentially formed in the printing areas A5 and A6. In FIG. 1, Im denotes an image forming region.

In the recording method of the present invention, for example, the recording apparatus shown in FIG. 1 is used to form an image by applying the ink In and the processing liquid Pr to the surface of the recording medium M by the droplet discharge device 20 as described above. Although an embodiment in which the processing liquid Pr is applied to the surface of the recording medium M before the ink In is shown in FIG. 1 and FIG. 2, in the recording method of the present invention, the application of the processing liquid Pr may be performed after the ink In. For example, by arranging a head 1Pr for the processing liquid Pr after the head for ink, a configuration may be employed in which the processing liquid Pr is applied after the application of the ink In.

In the recording method of the present invention, the amount of the ink In applied to each pixel area is determined by a known method in accordance with image data of a document. In the recording method of the present invention, as described above, the relationship between the amount of the ink In to be applied and the amount of the processing liquid Pr to be applied to the surface of the recording medium M is controlled as described above as described in the conditions (1) and (2).

In the above (1), the application amount of the processing liquid Pr is controlled so as to vary according to the application amount of the ink In for each unit area in which an image is formed. However, the application amount of the processing liquid Pr is controlled so that the application amount of the processing liquid Pr becomes equal to or less than 5 g/m$^2$ in all of the unit areas in which images are formed. In the recording method of the present invention, the unit area in which the application amount of the processing liquid Pr is equal to or less than 5 g/m$^2$ is all the unit areas in which images are formed. Here, the "all unit areas" may be, for example, 90% or more of the unit areas in which an image is formed. In the recording method of the present invention, more strictly speaking, the amount of the processing liquid Pr to be applied is controlled so as to be equal to or less than 5 g/m$^2$ in the unit area of 95% or more, more strictly, 98% or more, and particularly, 100% of the unit area in which images are formed in the recording method of the present invention.

The size of the unit area (hereinafter, also referred to as "unit area U") in which an image is formed is appropriately selected within a range in which the effect of the present invention may be exhibited. Specifically, one pixel may be a unit area U. Since the effect of the present invention may be easily exhibited, it is preferable that the unit area U has four or more pixels as one unit. Furthermore, it is more preferable that the unit area is 4 pixels composed of 2 vertical pixels×2 horizontal pixels, 16 pixels composed of 4 vertical pixels×4 horizontal pixels, and 36 pixels composed of 6 vertical pixels×6 horizontal pixels.

FIG. 3A to FIG. 3D are diagrams illustrating a simplified relationship between the applied amount of the ink In and the applied amount of the processed liquid Pr, in which four pixels composed of two vertical pixels by two horizontal pixels are set as the unit area U. In FIG. 3A to FIG. 3D, the left side indicates a position where the ink In (indicated by "CMYK" in the figure) is applied in the unit area U of four pixels, and the right side indicates a position where the processing liquid Pr is applied corresponding to the application of the ink In of the unit area U of the left side. In FIG. 3A to FIG. 3D, the amounts of the inks In (denoted by "CMYK" in the drawing) and the processing liquid Pr to be applied are described as, for example, 10 g/m$^2$ per pixel.

Figure 3A:
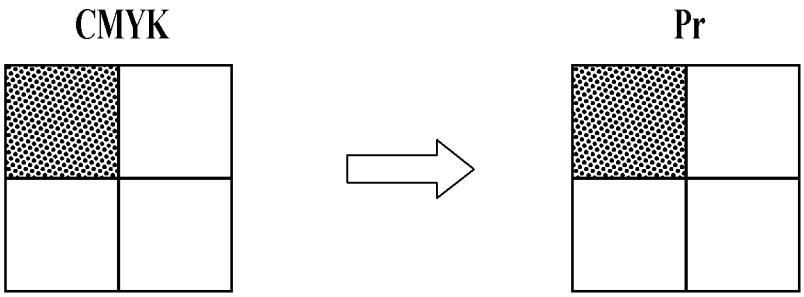
FIG. 3A is a diagram showing the relationship between the application amount of the ink In and the application amount of the processing liquid Pr using four pixels as the unit area (U).
Figure 3B:
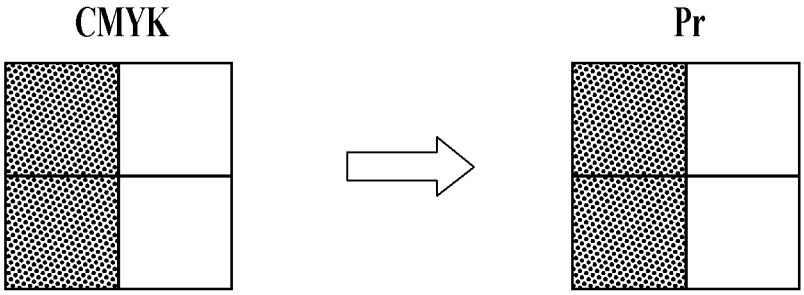
FIG. 3B is a diagram showing the relationship between the application amount of the ink In and the application amount of the processing liquid Pr using four pixels as the unit area (U).

In FIG. 3A, since the ink In is applied only to one pixel in the upper left, the amount of application per unit area U is 2.5 g/m$^2$. The application of the processing liquid Pr in the unit area U corresponding to this is performed only for one pixel at the upper left, and the application quantity per unit area U is 2.5 g/m$^2$. In FIG. 3B, the ink In is applied to two pixels (applied amount per unit area U; 5 g/m$^2$), and the processing liquid Pr is also applied to two pixels (applied amount per unit area U; 5 g/m$^2$) at the same position.

Figure 3C:
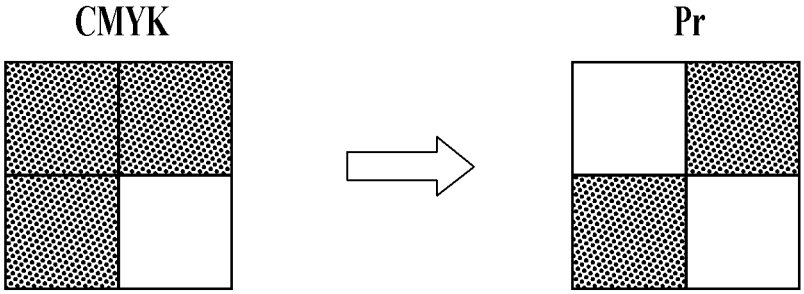
FIG. 3C is a diagram showing the relationship between the application amount of the ink In and the application amount of the processing liquid Pr using four pixels as the unit area (U).
Figure 3D:
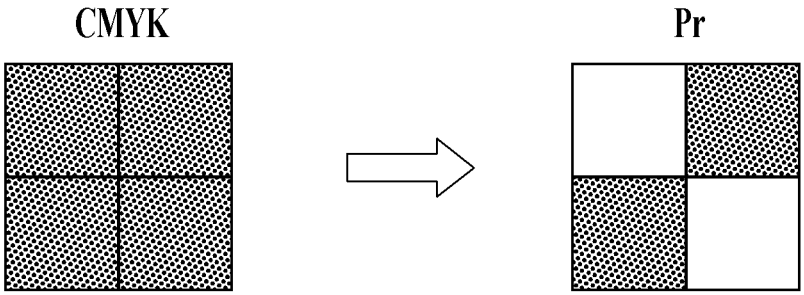
FIG. 3D is a diagram showing the relationship between the application amount of the ink In and the application amount of the processing liquid Pr using four pixels as the unit area (U).

In FIG. 3C, the ink In is applied to three pixels (application amount per unit area U; 7.5 g/m$^2$). In this case, when the processing liquid Pr is also given to the same three pixels, and the application amount per unit area U becomes 7.5 g/m$^2$, then, it does not satisfy the specification of the present invention (5 g/m$^2$ or less). Therefore, the application of the processing liquid Pr is made to be 2 pixels (application amount per unit area U; 5 g/m$^2$). Similarly, in FIG. 3D, the ink In is applied to four pixels (application amount per unit area U; 10 g/m$^2$), while the processing liquid Pr is applied to two pixels (application amount per unit area U; 5 g/m$^2$). In FIG. 3C and FIG. 3D, the application positions of the processing liquid Pr are two pixels at the upper right and the lower left, but in the present invention, since only the application amount of the processing liquid Pr is defined, the application positions may be any two pixels out of four pixels.

Figure 4A:
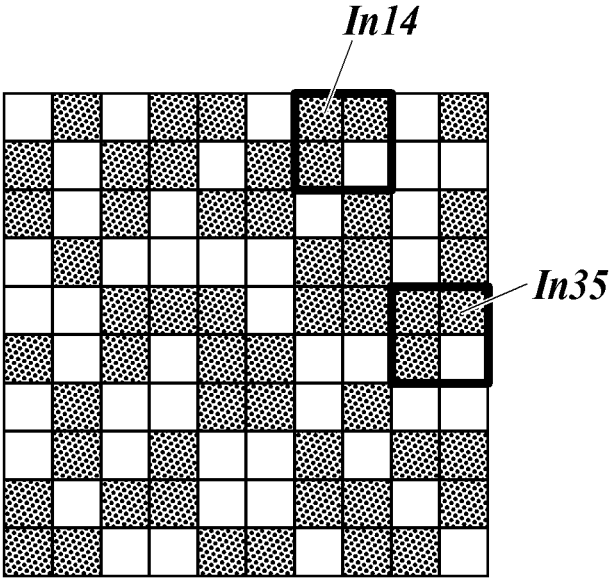
FIG. 4A is a diagram showing the relationship between the application amount of the ink In and the application amount of the processing liquid Pr.
Figure 4B:
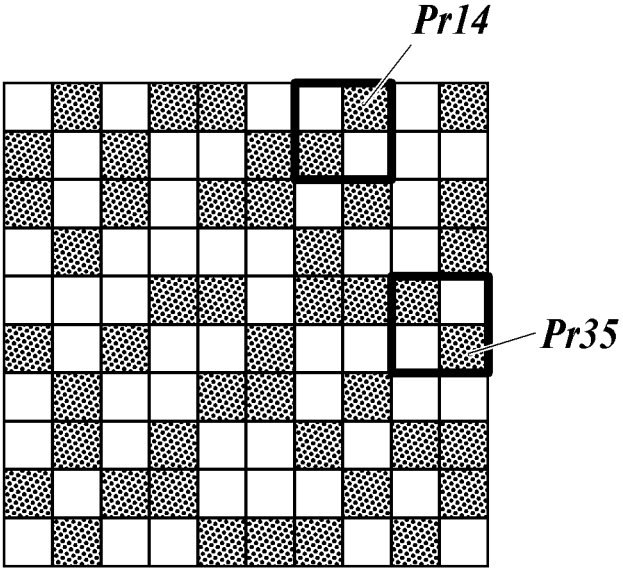
FIG. 4B is a diagram showing the relationship between the application amount of the ink In and the application amount of the processing liquid Pr.

Here, FIG. 4A and FIG. 4B show the relation between the position of the pixel to which the ink In has been applied (FIG. 4A) and the position of the pixel to which the processing liquid Pr has been applied (FIG. 4B) in the entire image forming region when the ink In and the processing liquid Pr have been applied based on the criterion shown in FIG. 3A to FIG. 3D with four pixels as the unit area U.

The entire image forming region shown in FIG. 4A and FIG. 4B has a configuration in which four pixels composed of two vertical pixels by two horizontal pixels are arranged as a unit area U, and a unit area U is arranged vertically by 5 and horizontally by 5, with a total of 25 unit areas U. In FIG. 4A and FIG. 4B, when the number of pixels to which the ink In was applied was 1 or 2 in each unit area U, the processing liquid Pr was applied to the same position as the ink In. When the number of pixels to which the ink In is applied is 3 or 4 in the unit area U, the application position of the processing liquid Pr is set to the same position as shown in FIG. 3C and FIG. 3D, or two pixels are set to the upper left and the lower right.

In the above examples, it is understood that the control condition (1) is achieved in which four pixels are used as the unit area U, the amount of the processing liquid Pr applied is changed for each unit area in accordance with the amount of the ink In applied, and the amount of the processing liquid Pr applied is controlled to be equal to or less than 5 g/m$^2$ in all of the unit areas U.

In the above example, the application amount of the ink In per pixel and the application amount of the processing liquid Pr are the same. The application amounts of the ink In and the processing liquid Pr may be appropriately adjusted by adjusting the amount of liquid per one droplet ejected from the nozzle in each head, and it is easy to make the amounts of the ink In and the processing liquid Pr different from each other. The ejection mechanism of the ink In or the processing liquid Pr in the head will be described later in the recording apparatus, but the amount of liquid per one droplet of the ink In and the processing liquid Pr ejected from the nozzle may be adjusted in the range of approximately 2 to 40 pL.

In addition, the landing time of the ink In ejected from the nozzles in the head is preferably 1.0 seconds or less, more preferably 0.6 seconds or less. Similarly, the landing time of the processing liquid Pr ejected from the nozzle is preferably 1.0 seconds or less, more preferably 0.6 seconds or less. The landing time of the ink In and the processing liquid Pr corresponds to the time from the ejection of the ink In and the processing liquid Pr from the nozzles to the merging on the recording medium M. In other words, the time from when the ink In and the processing liquid Pr are ejected until they are combined is preferably 1.0 seconds or less, more preferably 0.6 seconds or less. The moving speed of the droplet discharge device 20 having the head unit 1 is preferably 300 to 800 mm/sec.

Preferably, the relationship between the amount of the ink In applied and the amount of processing liquid Pr applied in the unit area is substantially proportional to the amount of the ink In applied when the amount of the ink In applied and the amount of processing liquid Pr applied in the unit area is 5 g/m$^2$ or less, and the ratio of the amount of processing liquid Pr applied to the amount of the ink In applied is preferably reduced as the amount of the ink In applied is increased. Further, it is preferable that the ratio of the application amount of the processing liquid Pr to the application amount of the ink In is 100% or less in all of the unit areas U, and it is preferable to be 45% or less when the application amount of the ink In in the unit areas U is 9 g/m$^2$ or more.

Here, it is particularly preferable that the unit area in which the ratio of the amount of the processing liquid Pr applied to the amount of the ink In applied has the above relationship is the entire unit area in which the image is formed. However, as long as an effect is obtained, in at least 90% of the unit area in which an image is formed, preferably 95% or more, and more preferably 98% or more, the ratio of the amount of the processing liquid Pr applied to the amount of the ink In to be applied may be the above relationship.

In the recording method of the present invention, the application amount of the processing liquid Pr is controlled so as to satisfy condition (1), whereby a high-quality image in which the occurrence of cracking or granularity in the ink coating film is suppressed may be obtained. Further, a higher effect is obtained by controlling the application amount of the processing liquid Pr under the above preferable conditions.

Figure 7:
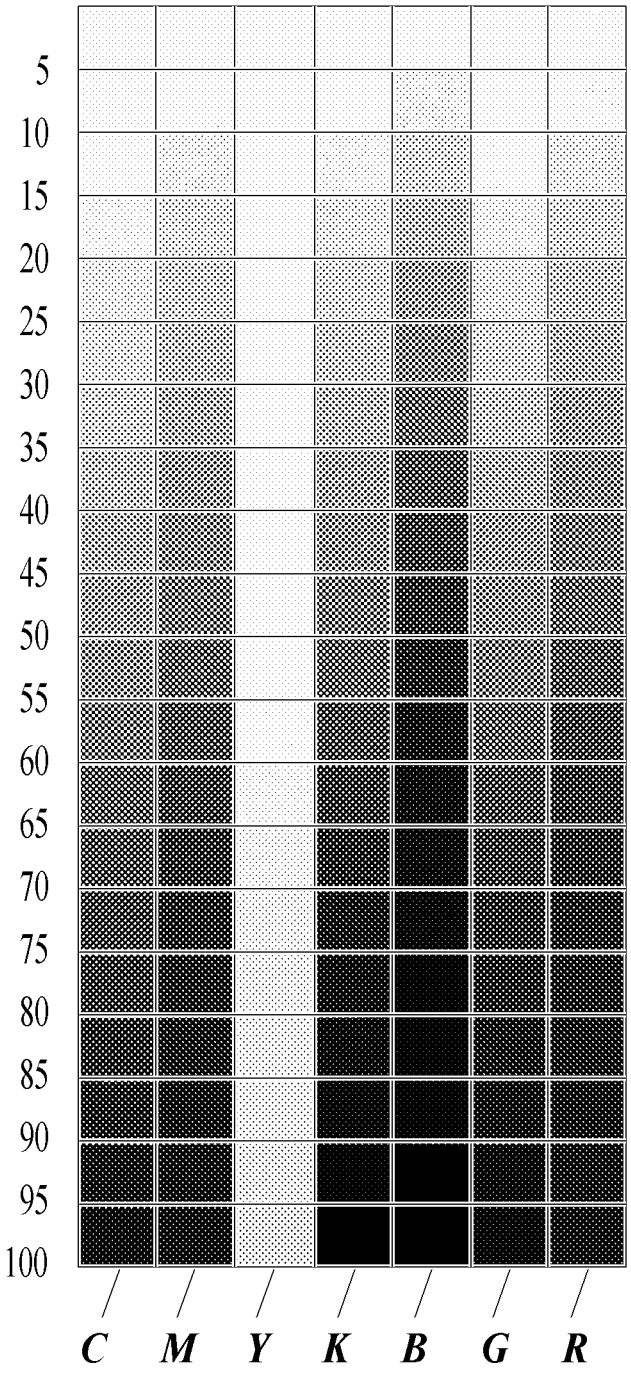
FIG. 7 is a diagram illustrating a document image 1 used in the recording method of the example.
Figure 9:
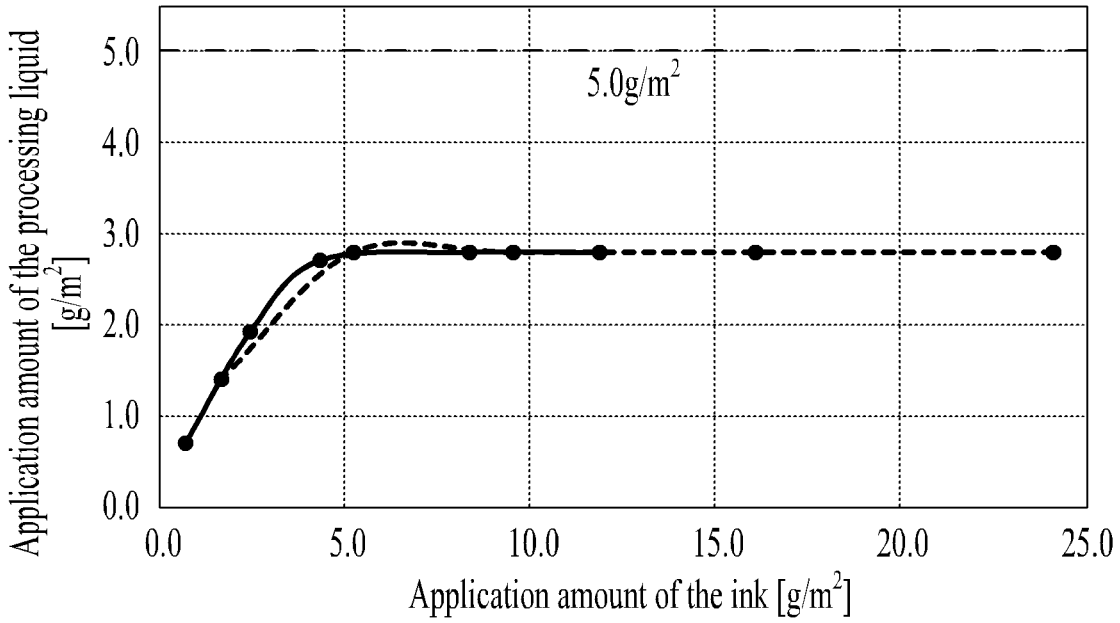
FIG. 9 is a graph showing the relationship between the application amount of the ink In and the application amount of the processing liquid Pr in Example 1.
Figure 10:
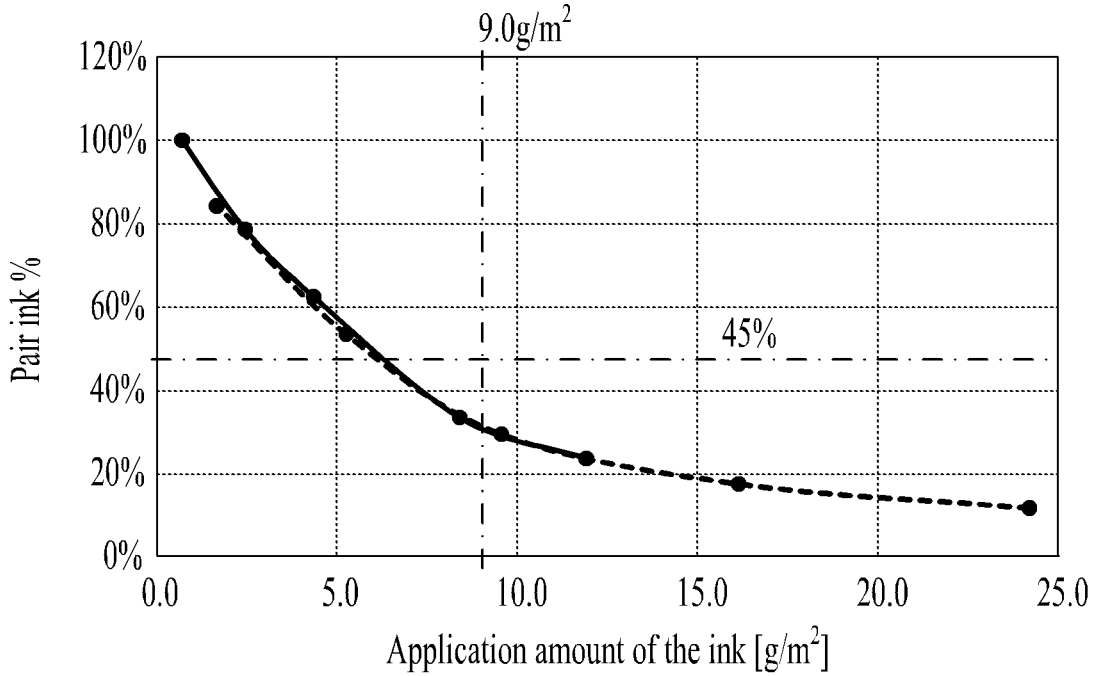
FIG. 10 is a graph showing the relationship of the ratio (%) between the application amount of the ink In and the application amount of the processing liquid Pr in Example 1.

Hereinafter, a relationship between the amount of the ink In to be applied and the amount of the processing liquid Pr to be applied in the unit area U will be more specifically described with reference to Example 1 described later as an example. As the unit area U, 4 pixels are set as the unit area U in the same manner as described above. FIG. 9 is a graph showing the relationship between the amount of the ink In applied per unit area U [g/m$^2$] and the amount of the processing liquid applied [g/m$^2$] per unit area U when the image corresponding to the document image shown in FIG. 7 is formed by the recording method of Example 1. FIG. 10 shows the relationship of the ratio [%] between the amount of the ink In applied [g/m$^2$] and the amount of processing liquid Pr applied to the amount of the ink In applied (indicated as "pair ink %" in the figure).

In FIG. 9 and FIG. 10, a solid line is a graph in the case of C, M, Y, and K, and a broken line is a graph in the case of R, G, and B. Referring to the control condition of the relationship between the application amount [g/m$^2$] of the ink In per unit area U and the application amount [g/m$^2$] of the processing solution Pr in Example 1, the application amount of the processing solution Pr is 2.8 g/m$^2$ at the maximum, and 5 g/m$^2$ or less in all unit areas U is achieved, which is the condition (1) described above. According to the control condition (1), the maximum value of the application amount of the processing liquid Pr is preferably equal to or less than 4.0 g/m$^2$, and more preferably equal to or less than 3.0 g/m$^2$.

Regarding the control condition (1), the application amount [g/m$^2$] of the processing solution Pr per unit area U varies according to the application amount [g/m$^2$] of the ink In, as shown examples in FIG. 3A to FIG. 3D, FIG. 4A, and FIG. 4B and Example 1 in in FIG. 9 and FIG. 10. In the range where the amount of the ink In applied in the unit area is relatively small, for example, when it is 5 g/m$^2$ or less, the amount of the processing liquid Pr applied is preferably substantially proportional to the amount of the ink In applied. Further, in the area, the amount of the processing liquid Pr applied is preferably the same as the amount of the ink In applied at the maximum.

More particularly, the amount of the processing liquid Pr to be applied may be set to 0 to 100% of the amount of the ink to be applied when the amount of the ink to be applied per unit area U is equal to or less than 1.0 g/m$^2$, and is preferably 0 to 25%, more preferably 0%. That is, it is more preferable that the processing liquid Pr is not applied. When the amount of the ink applied per unit area U exceeds 1.0 g/m$^2$ and is equal to or less than 5.0 g/m$^2$, it is preferable that the amount of the processing liquid Pr applied is substantially proportional to the amount of the ink In. In this case, it is preferable that the amount of the processing liquid Pr to be applied is within a range of 5 to 85% of the amount of the ink to be applied.

Further, when the amount of the ink In per unit area U exceeds 5.0 g/m$^2$, it is preferable that the amount of the processing liquid Pr is substantially unchanged. For example, it is preferable that the application amount of the processing liquid Pr is maintained at the same value as the maximum value when the application amount of the ink In is 5.0 g/m$^2$, and the application amount of the processing liquid Pr is maintained at the same value as the maximum value when the application amount of the ink In exceeds 5.0 g/m$^2$. As described above, the maximum value of the application amount of the processing liquid Pr is equal to or less than 5.0 g/m$^2$, preferably equal to or less than 4.0 g/m$^2$, and more preferably equal to or less than 3.0 g/m$^2$. When the amount of the ink In to be applied exceeds 5.0 g/m$^2$, the lower limit of the amount of the processing liquid Pr to be applied is preferably 1.0 g/m$^2$, and more preferably it is 1.4 g/m$^2$.

Further, from FIG. 10, it is understood that the ratio of the amount of application of the processing liquid Pr (hereinafter, also referred to as "pair ink %") to the amount of application of the ink In in the unit area U in Example 1 is controlled so as to be 100% or less in all of the unit areas U, and 45% or less when the amount of application of the ink In in the unit area U is 9 g/m$^2$ or more. In the recording method of the present invention, it is preferable that the relationship between the pair ink % and the amount of the ink In applied in the unit area U is such that the pair ink % decreases from 100% to almost inversely proportional as the amount of the ink In increases.

As described above, when the amount of the ink In applied per unit area U is 9.0 g/m$^2$ or more, the pair ink % is preferably 45% or less. When the amount of the ink In per unit area U is equal to or more than 15.0 g/m$^2$, it is preferable that the pair ink % to the ink be equal to or less than 30%. When the amount of the ink In per unit area U is 9.0 to 15.0 g/m$^2$, the pair ink % to the ink is preferably 5% or more, and more preferably 9% or more. Further, when the amount of the ink In per unit area U exceeds 15.0 g/m$^2$, the pair ink % to the ink is preferably 3% or more, and more preferably 6% or more.

Next, control of the amount of the processing liquid Pr applied between the printing passes described above condition (2) in the recording method of the present invention will be described.

In the above condition (2), when an image is formed in a plurality of printing passes, in the unit area in which the application amount of the processing liquid is equal to or more than 0.8 g/m$^2$, an average value of the application amounts of the processing liquid in the unit area in each printing pass is controlled so that a deviation when compared between the printing passes is within ±30%.

As described above, in the case of the scanning method as shown in FIG. 1, the operation of applying the ink and the processing liquid to the recording medium M by one movement of the droplet discharge device 20 in the scanning direction X is performed as one printing pass, and a plurality of printing passes are performed in the same area, and finally, a desired image is formed on the recording medium M.

The number of printing passes is determined by the required image quality and productivity. Increasing the number of printing passes reduces the amount of ink applied at one time, improving image quality but reducing productivity. Furthermore, the number of printing passes is also influenced by the number of heads used and by the resolution. For example, when a head having a resolution of 360 dpi is used alone, at least two or more print passes are required to form an image of 720 dpi. In the scanning type recording apparatus, the number of printing passes is operated twice or four times because of the apparatus cost (the number of heads that can be mounted) and the required productivity.

In the recording method of the present invention, image formation on the recording medium M is performed in one to a plurality of printing passes. Here, for example, assuming that image formation is performed in two printing passes in a predetermined print area, the amount of the ink In applied in the unit area U finally obtained is divided into two, usually two equally divided, per printing pass, and the total of the amount of the ink In applied in two times is the amount of the ink In applied in the unit area U.

Here, in order to distinguish from the amount of the ink In finally applied to the unit area U, the amount of the ink In applied for each printing pass is referred to as a "divided application amount of the ink In". Also, as for the amount of the processing liquid Pr to be applied, the amount of the processing liquid Pr to be finally applied to the unit area U is referred to as the amount of the processing liquid Pr to be applied, and the amount of the processing liquid Pr to be applied for each printing pass is referred to as the "divided application amount of the processing liquid Pr".

Even when the above two printing passes are performed, the application amount of the processing liquid Pr in the corresponding unit area U is controlled based on the control condition (1) in accordance with the application amount of the ink In in the unit area U. Here, when the control condition (2) in the recording method of the present invention is applied when two printing passes are performed, in the unit area U in which the application amount of the processing solution Pr is equal to or more than 0.8 g/m$^2$, an average value of the divided application amount of the processing solution Pr in the unit area U in the first printing pass and an average value of the divided application amount of the processing solution Pr in the unit area U in the second printing pass are obtained, and the deviation of these average values when compared in the two printing passes is controlled to be within f 30%.

For example, in the print area A1, when the unit area U in which the application amount of the processing liquid Pr is equal to or more than 0.8 g/m$^2$ exists in three places: U1 (application amount of the processing liquid Pr; 1.4 g/m$^2$), U2 (application amount of the processing liquid Pr; 2.5 g/m$^2$), and U3 (application amount of the processing liquid Pr; 3 g/m$^2$), and when the divided application amounts of the processing liquid Pr of U1 to U3 in the first printing pass are: 0.7 g/m$^2$, 1.2 g/m$^2$, and 1.5 g/m$^2$, respectively, and the divided application amounts of the processing liquid Pr of U1 to U3 in the second printing pass are: 0.7 g/m$^2$, 1.3 g/m$^2$, and 1.5 g/m$^2$, respectively, the deviation is calculated as follows.

An average value of the divided application amounts of the processing liquid Pr of U1 to U3 in the first print pass is (0.7+1.2+1.5)/3=1.13 g/m$^2$. An average value of the divided application amounts of the processing liquid Pr of U1 to U3 in the second print pass is (0.7+1.3+1.5)/3=1.16 g/m$^2$. The deviation between 1.13 g/m$^2$ and 1.16 g/m$^2$ is ±1.3% and it is within the condition (2).

Note that the deviation in this specification is obtained by calculating the difference between the value and the average value of the population (average value−the value concerned) for each individual value constituting the population, and expressing the obtained value as a percentage (%) for a value obtained by dividing the obtained value by the average value of the population. For example, when printing is performed in four printing passes, the average value of the divided application amounts of the processing liquid Pr is calculated for each printing pass. The average values for the first to fourth print passes are Av1, Av2, Av3 and Av4, respectively. The deviation in each printing pass is determined by the above-described method. In the recording method of the present invention, all of them are controlled so as to be within f 30%.

Regarding the control condition (2), the deviation between the printing passes of the average value of the divided application amount of the processing liquid Pr in the predetermined unit area U described above is preferably within ±15%, more preferably within ±10%. As a result, in the unit area U in which the application amount of the processing liquid Pr is equal to or more than 0.8 g/m$^2$, there is almost no difference in the divided application amount of the processing liquid Pr between the printing passes, and the processing liquid Pr may be applied substantially uniformly between the printing passes.

In the recording method of the present invention, when an image is formed on the recording medium M in a plurality of printing passes, it is preferable to control the average value of the divided application amounts of the ink in the unit area in each printing pass to be within ±30% when compared between the printing passes in the unit area in which the application amount of the ink is equal to or more than 1.5 g/m$^2$. The deviation is preferably within ±15%, and more preferably within ±10%. Thus, in the unit area U in which the amount of the ink In to be applied is equal to or larger than 1.5 g/m$^2$, there is almost no difference in the divided application amount of the ink In between the printing passes, so that the ink In may be applied substantially evenly between the printing passes.

In the recording method of the present invention, for example, the unit area U in which the amount of the ink In applied is equal to or greater than 1.5 g/m$^2$ correlates with the unit area U in which the amount of the processing liquid Pr applied is equal to or greater than 0.8 g/m$^2$. Therefore, when image formation is performed on the recording medium M in a plurality of printing passes in the printing method of the present invention, it is preferable that the deviation is within ±30% when the average value of the ratio of the divided application amount of the processing liquid Pr to the divided application amount of the ink In for each printing pass (the pair ink % (division)) in the unit area U in which the application amount of the ink In is equal to or greater than 1.5 g/m$^2$ or the unit area U in which the application amount of the processing liquid Pr is equal to or greater than 0.8 g/m$^2$ is compared between the printing passes. The deviation is preferably within ±15%, more preferably within ±10%.

Thus, in the unit area U in which the application amount of the ink In is equal to or more than 1.5 g/m$^2$ or in the unit area U in which the application amount of the processing liquid Pr is equal to or more than 0.8 g/m$^2$, there is almost no difference in the pair ink % (division) between the printing passes, and the pair ink % (division) may be made substantially equal between the printing passes.

The number of printing passes in the predetermined area A is determined by a program previously set in the control unit in correspondence with the document image. Depending on the document image, the number of printing passes is approximately 2 to 4.

In the recording method of the present invention, the relationship between the amount of the ink In applied and the amount of the processing liquid Pr applied in the unit area where the image is formed is controlled so as to satisfy the conditions (1) and (2). In the region where the image is formed, the application of the processing liquid is preferably performed by an error diffusion method. In other words, it is preferable that the dot pattern of the processing liquid applied to the region where the image is formed be a pattern based on the error diffusion method. A dither method may be used instead of the error diffusion method.

FIG. 4A and FIG. 4B will be described as an example. FIG. 4A is a diagram showing a position (dot pattern) of a pixel to which the ink In is given in the entire image forming region, and FIG. 4B shows a position (dot pattern) of a pixel to which the processing liquid Pr is given so as to correspond to a dot pattern of the ink In in FIG. 4A. Here, when the position of the unit area U constituting FIG. 4A is indicated by "In+row number+column number", In14 and In35 have the same dot pattern. Specifically, the number of pixels to which the ink In is applied is 3, and the application positions thereof are also the same.

Similarly, the position of the unit area U constituting FIG. 4B is indicated by "Pr+row number+column number". The positions corresponding to In14 and In35 are Pr14 and Pr35. As described above, In14 and In35 have the same dot pattern, but Pr14 and Pr35 have different dot patterns. This is because the dot patterns of the unit areas in which Pr14 and Pr35 adjoin each other differ from each other. This is because in FIG. 4B, the application amount of the processing liquid Pr in the unit area satisfies the control condition (1), and the application position is formed by a dot pattern based on the error diffusion method.

Further, in an image divided by a plurality of printing passes, the application position may be operated in order to equalize the application of the processing liquid Pr between the printing passes.

In the recording method of the present invention, when the formation of an image on the surface of the recording medium is performed so that the print areas corresponding to the print widths of the droplet discharge device are arranged in parallel, it is preferable to relatively increase the application amount of the processing liquid in the vicinity of the boundary between the print areas. When the recording apparatus of the scanning method as shown in FIG. 1 is used, for example, as shown in FIG. 1, the entire print area P is formed by paralleling the print areas (A1 to A6) corresponding to the printing width (the width W of the head unit 1 in FIG. 1) of the droplet discharge device 20.

In this case, for example, in the print area A1 and the print area A2, the vicinity of the boundary is a range of, for example, 0.030 to 0.150 mm from the boundary between them to the inside of the print area A1 and the print area A2, respectively. In the case of relatively increasing the application amount of the processing liquid in the region in this range, that is, in the vicinity of the boundary, it is preferable to increase the application amount of the processing liquid in the vicinity of the boundary, so that the ratio of the application amount of the processing liquid in the vicinity of the boundary to the application amount of the processing liquid in the region other than the vicinity of the boundary (hereinafter, also referred to as "central region") is, for example, within a range of 110 to 300%, and more preferably, the application amount of the processing liquid is increased to be within a range of 110 to 200%. However, the application amount of the processing liquid Pr is 5.0 g/m$^2$ or less even in the vicinity of the border.

More specifically, for example, in the central region, when the application amount of the ink In in the unit area U is 5 g/m$^2$ and the application amount of the processing solution Pr is set to 3 g/m$^2$, in the vicinity of the boundary, the application amount of the processing solution Pr is increased to 3.3 to 5.0 g/m$^2$ when the application amount of the ink In in the unit area U is 5 g/m$^2$, and the application of the processing solution Pr is performed. For example, when the application amount of the ink In and the application amount of the processing liquid Pr are controlled for each unit area U in the central area in the relation shown in FIG. 9, it is preferable that the entire graph is controlled so that the processing liquid Pr is applied in the application amount that rises upward within the range of the above-mentioned ratio (110 to 300% of the application amount of the processing liquid Pr in the central area; however, the application amount of the processing liquid Pr in the vicinity of the boundary is 5.0 g/m$^2$ or less) in the vicinity of the boundary.

In the recording method of the present invention, an ink In and a processing liquid Pr are applied to an image forming region in which an image is formed, for example, an area indicated by Im in FIG. 1, so as to conform to the control conditions (1) and (2) above, and further preferably to satisfy the various conditions listed above.

Figure 5:
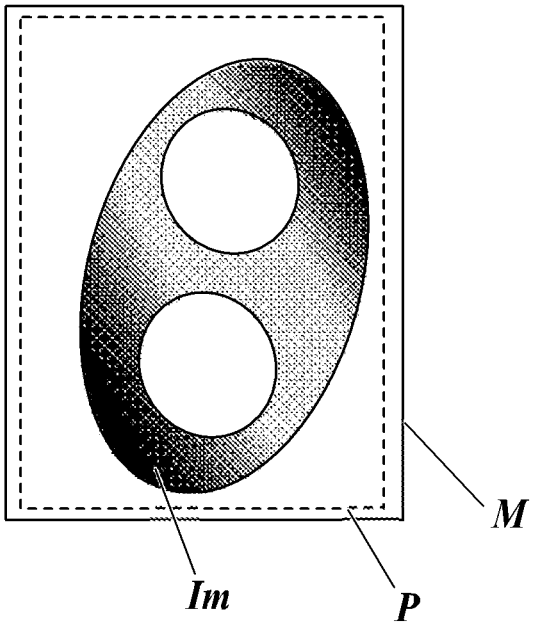
FIG. 5 is a diagram showing an example of a recording medium on which an image is formed by the recording method of the present invention using the recording apparatus of FIG. 1.

FIG. 5 shows an example of a recording medium on which an image is formed by the recording method of the present invention using the recording apparatus of FIG. 1. The image forming region Im shown in FIG. 5 corresponds to a document image. FIG. 5 shows a state in which image formation is completed for the recording medium M on which an image is being formed in FIG. 1. When an image is formed in the entire print area P on the surface of the recording medium M by the two-liquid type inkjet recording method, for example, in the case of an image of a document on a personal computer, the arrangement of pixels to which the ink In is applied, and the application amount, in the entire print area P are determined based on the image data subjected to the halftone processing, and the arrangement, the application amount of pixels to which the processing liquid Pr is applied are determined so as to correspond to the arrangement and the application amount.

In the example shown in FIG. 5, the ink In is applied to the image forming region Im on the recording medium M in accordance with the application position and the application amount determined based on the image data of the original. Further, the processing liquid Pr is applied in the image forming region Im by the recording method of the present invention. Specifically, it is given so as to meet the control conditions (1) and (2) above, and more preferably to satisfy the various conditions described above.

Here, in the recording method of the present invention, it is preferable that the processing liquid Pr is also applied to the peripheral region of the image forming region in addition to the image forming region. Then, it is preferable that the amount of the processing liquid Pr applied to the peripheral region is the same as the amount of the processing liquid Pr applied at the end portion of the image forming region adjacent to the peripheral region.

Figure 6:
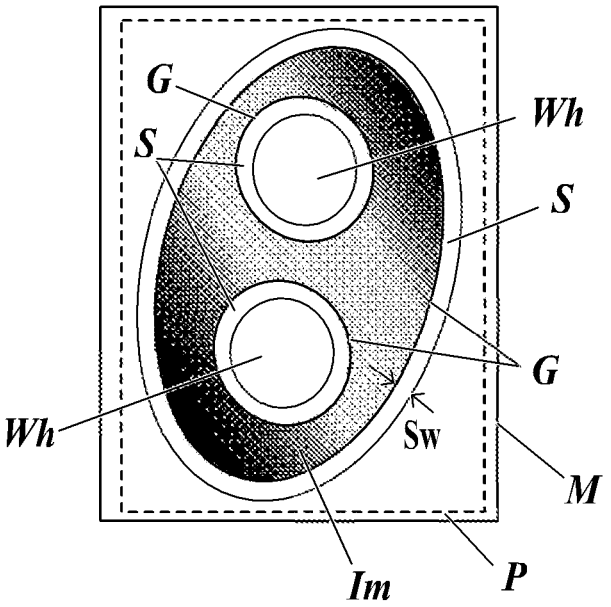
FIG. 6 is a diagram showing another example of a recording medium on which an image is formed by the recording method of the present invention using the recording apparatus of FIG. 1.

FIG. 6 is a diagram showing another example of a recording medium on which an image is formed by the recording method of the present invention using the recording apparatus of FIG. 1. The image forming region Im shown in FIG. 6 corresponds to a document image formed using the same document image as the image forming region Im shown in FIG. 5. In the example shown in FIG. 6, the ink In is applied only to the image forming region Im on the recording medium M, and the processing liquid Pr is applied to both the image forming region Im and the peripheral region S of the image forming region Im.

In the example of FIG. 6, the ink In and the processing liquid Pr are further preferably given to the image forming region Im by the recording method of the present invention in the same manner as the example of FIG. 5 so that it may suit the control conditions (1) and (2) mentioned above, and still more preferably, so that various conditions mentioned above may be satisfied. Then, the processing liquid Pr is also applied to the peripheral region S. The amount of the processing liquid Pr applied to the peripheral region S is set to be the same as the amount of the processing liquid Pr applied to the end portion of the image forming region Im adjacent to the peripheral region S. As a result, an effect of suppressing the occurrence of ink bleeding in the vicinity of the boundary between the image forming region Im and the peripheral region S may be obtained.

For example, if the processing liquid Pr applied to the unit area U is 2 g/m$^2$ at the end portion of the image-forming region Im adjacent to the peripheral region S, the processing liquid Pr is applied at the application amount 2 g/m$^2$ in the peripheral region S. If the application amount of the processing liquid Pr in the peripheral region S is larger than the application amount of the processing liquid Pr to the end portion of the image forming region Im adjacent to the peripheral region S, cracking may occur in the ink coating film, and if it is small, bleeding of ink in the vicinity of the boundary between the image forming region Im and the peripheral region S may not be sufficiently suppressed. In the present invention, the "same amount" is treated as the "same amount" if it is within the error range of the applied amount caused by the performance of the recording apparatus such as the discharge performance of the processing liquid Pr in the head.

Incidentally, the bleeding of ink in the vicinity of the boundary between the image forming region Im and the peripheral region S tends to occur when the amount of the ink In applied at the end portion of the image forming region Im is large, and the effect of applying the processing liquid Pr to the peripheral region S is large. On the other hand, when the amount of the ink In applied at the end portion of the image forming region Im is small, if the processing liquid Pr is applied to the peripheral region S, the ink bleeding may occur in the vicinity of the boundary.

From this point of view, in the recording method of the present invention, when the amount of the ink In applied to the unit area U is equal to or less than 15 g/m$^2$, at the end portion of the image forming region Im, it is preferable that the recording method of the present invention is controlled so that the processing liquid Pr is not applied to the peripheral region S of the unit area U at the end portion of the image forming region Im. That is, when the amount of the ink In applied to the unit area U exceeds 15 g/m$^2$, at the end portion of the image-forming region Im, it is preferable that the processing liquid Pr is applied in the peripheral region S adjoining the unit area U at the same amount as the processing liquid Pr applied to the end portion of the image forming region Im.

The peripheral region S is preferably a region of 0.030 to 0.200 mm outside the outer periphery G of the image forming region Im, more preferably a region of 0.030 to 0.150 mm outside the outer periphery G. That is, the width Sw of the peripheral region S is preferably 0.030 to 0.200 mm, more preferably 0.030 to 0.150 mm.

Note that the outer periphery G of the image forming region Im indicates the contour of the image forming region Im, and when there is a blank region Wh inside which no image is formed as in the image forming region Im shown in FIG. 6, the boundary line between the blank region Wh and the image forming region Im also falls within the category of the outer periphery G. Here, the outer periphery G of the image forming region Im may be detected by various methods (Sobel method, Laplacian of Gaussian method, and Canny method) as a border where the difference in the density of the image is large with respect to the image of the original prior to the halftone processing, when the arrangement of the pixels to which the inks In are applied is determined by performing the halftone processing on the image of the original.

In the recording method of the present invention, after the ink In and the processing liquid Pr are applied to the surface of the recording medium and combined as described above, an image is usually formed by drying the combined liquid components to obtain an ink coating film. Drying may be performed by a known method depending on the composition and the amount of the ink In and the processing liquid Pr described below.

Next, an ink In containing at least a coloring material and a processing liquid Pr containing at least a flocculant used in the recording method of the present invention will be described.

[Ink]

The ink In according to the present invention contains at least a coloring material. As the coloring material, a pigment is preferred. It is preferable that the ink In contains, for example, a pigment as a coloring material, a polymer dispersant for dispersing the pigment, and a resin fine particle, and water and an organic solvent as a medium.

(Coloring material)

As a pigment for a coloring material contained in an ink according to the present invention, an anionic dispersing pigment, for example, an anionic self-dispersing pigment or a pigment dispersed by an anionic polymer dispersant may be used, and in particular, a pigment dispersed by an anionic polymer dispersant is suitable.

As the pigment, conventionally known ones may be used without any particular limitation, and for example, an organic pigment such as an insoluble pigment or a lake pigment and an inorganic pigment such as titanium oxide may be preferably used.

It is to be noted that, in titanium oxide, which is generally difficult to secure ink ejection stability and adhesion, the present invention makes it possible to particularly preferably prevent bleeding and improve adhesion.

Titanium oxide has three crystal forms anatase type, rutile type, and perovskite type, but it may be broadly classified into anatase type and rutile type for general purposes. Although not particularly limited, a rutile type having a large refractive index and high hiding property is preferred. Specific examples include the TR series of Fuji Titanium Industry Co., Ltd., the JR series of Tayca Corporation, and TIPAQUE™ of Ishihara Sangyo Kaisha, Ltd.

The insoluble pigment is not particularly limited, and for example, azo, azomethine, methine, diphenylmethane, triphenylmethane, quinacridone, anthraquinone, pelylene, indigo, quinophthalone, isoindolinone, isoindoline, azine, oxazine, thiazine, dioxazine, thiazole, phthalocyanine, and diketopyrrolopyrrole are preferable.

Specific organic pigments which may be preferably used include the following pigments.

Pigments for magenta or red include, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment 144, C.I. Pigment 149, C.I. Pigment 166, C.I. Pigment 178, C.I. Pigment Red 222, and C.I. Pigment Violet 19.

Pigments for orange or yellow include, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 15:3, C. I. Pigment Yellow 17, C. I. Pigment Yellow 74, C. I. Pigment Yellow 93, C. I. Pigment Yellow 128, C. I. Pigment Yellow 94, C. I. Pigment 138, and C. I. Pigment Yellow 155. In particular, C.I. Pigment Yellow 155 is preferred in the balance of color tone and light resistance.

Pigments for green or cyan include, for example, C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Further, examples of the pigment for black include C.I. Pigment Black 1, C.I. Pigment Black 6, and C.I. Pigment Black 7.

(Polymer Dispersant)

The polymer dispersant used for dispersing the pigment is not particularly limited, but a polymer dispersant having an anionic group is preferred, and a polymer dispersant having a molecular weight within a range of 5000 to 200000 may be suitably used.

Examples of the polymer dispersant include a block copolymer having a structure derived from 2 or more monomers selected from styrene, styrene derivative, vinylnaphthalene derivative, acrylic acid, acrylic acid derivative, maleic acid, maleic acid derivative, itaconic acid, itaconic acid derivative, fumaric acid, and fumaric acid derivative, a random copolymer and a salt thereof, a polyoxyalkylene, and a polyoxyalkylene alkyl ether.

The polymer dispersant preferably has an acryloyl group, and is preferably added by neutralizing with a neutralizing agent (neutralizing base). Here, the neutralizing base is not particularly limited, but is preferably an organic base such as ammonia, monoethanolamine, diethanolamine, N-methyldiethanolamine, triethanolamine, or morpholine. In particular, when the pigment is titanium oxide, it is preferable that the titanium oxide is dispersed with a polymer dispersant having an acryloyl group.

As the polymer dispersant, a commercially available product may be used. Examples of the commercially available product of the polymer dispersant include Joncryl™ 819 manufactured by BASF Co., Ltd.

Further, the amount of the polymer dispersant added is preferably within a range of 10 to 100% by mass, more preferably within a range of 10 to 40% by mass, based on the pigment.

It is particularly preferred that the pigment has a so-called capsule pigment form in which the pigment is coated with the above polymer dispersant. As a method of coating the pigment with a polymer dispersant, various known methods may be used, and examples thereof include a phase inversion emulsification method, an acid precipitation method, or a method in which a pigment is dispersed by a polymerizable surfactant, and a monomer is supplied thereto and coated while being polymerized may be preferably exemplified.

As a particularly preferred method, there may be mentioned a method in which a water-insoluble resin is dissolved in an organic solvent such as methyl ethyl ketone, and further, an acidic group in the resin is partially or completely neutralized with a base, and then a pigment and ion-exchanged water are added and dispersed, and then the organic solvent is removed and, if necessary, water is added to prepare the solution.

The average particle diameter of the pigment dispersed in the ink is preferably 50 nm or more and less than 200 nm. Thus, dispersion stability of the pigment may be improved, and storage stability of the ink may be improved. The particle size of the pigment may be measured by a commercially available particle size measuring instrument using a dynamic light scattering method, or an electrophoresis method, but the measurement by a dynamic light scattering method is simple and the particle size region may be measured with high accuracy.

The pigment may be dispersed and used by a disperser together with a dispersant and other necessary additives depending on various desired objects.

As the disperser, conventionally known ball mill, sand mill, line mill, or high-pressure homogenizer may be used. Among them, when the pigment is dispersed by a sand mill, the particle size distribution becomes sharp, which is preferable. Further, although the material of the beads used for the sand mill disperse is not particularly limited, it is preferably zirconia or zircon from the viewpoint of preventing the generation of bead debris and the contamination of the ionic component. Moreover, this bead diameter is preferably within a range of 0.3 to 3 mm.

Although the content of the pigment in the ink is not particularly limited, for titanium oxide, the content is preferably within a range of 7 to 18% by mass, and for the organic pigment, the content is preferably within a range of 0.5 to 7% by mass.

(Resin Particles)

The resin fine particles used in the ink according to the present invention are preferably water-insoluble resin fine particles. The water-insoluble resin fine particles used in the present invention are fine particle dispersions of a water-insoluble resin which may receive an ink and exhibit solubility or affinity for the ink.

As described above, the water-insoluble resin fine particles are those which are inherently water-insoluble, but have a form in which a resin is dispersed in an aqueous medium as micro fine particles, and which are forcibly emulsified using an emulsifier and dispersed in water, or a water-insoluble resin which may be self-emulsified by itself without using an emulsifier or a dispersion stabilizer by introducing a hydrophilic functional group into the molecular. These resins are usually used in an emulsion-dispersed state in water or a water/alcohol mixed solvent.

As the resin used, at least, it is preferable to be a polyester-based resin, a polyurethane-based resin, a polyacrylic resin or a composite resin fine particle of a polyurethane-based resin and a polyacrylic resin.

As for the composite resin fine particles of the polyester-based resin, the polyurethane-based resin, the polyacrylic resin or the polyurethane-based resin and the polyacrylic-based resin, those described in detail in the section of the processing liquid described later are preferably used as appropriate, but the resin fine particles used in the processing liquid are preferably cationic or nonionic in ionic properties, whereas the resin fine particles used in the ink are preferably anionic.

Among them, the resin fine particles used in the ink preferably contain an acid structure, and even if the amount of the surfactant added is small, it becomes possible to disperse them in water, thereby improving the water resistance of the ink layer. This is referred to as a self-emulsifying type, and means that a urethane-based resin may be dispersed and stabilized in water only by molecular ionicity without using a surfactant. Examples of acid structures include acid groups such as a carboxy group (—COOH) and a sulfonic acid group (—$SO_3H$). The acid structure may be present in the side chain in the resin and may be present at the terminal.

It is preferable that a part or all of the above acid structure is neutralized. By neutralizing the acid structure, water dispersibility of the resin may be improved. Examples of neutralizing agents which neutralize the acid structure are preferably organic amines, and organic amines such as trimethylamine, triethylamine, tripropylamine, tributylamine, N-methyldiethanolamine, and triethanolamine are preferably used.

As the resin fine particles used in the ink, a commercially available product may be used. Examples of the commercially available product of resin fine particles are listed below according to the type of resin.

<Polyester Resin>

Pesresin™ A-110F, A-520, A-613D, A-615GE, A-640, A-645GH, A-647GEX manufactured by Takamatsu Oil & Fat Co., Ltd.; and Elitel™ KA-5034, KA-5071S, KA-1449, KA-0134, KA-3556, KA-6137, KZA-6034, KT-8803, KT-8701, KT-9204, KT-8904, KT-0507, KT-9511 manufactured by Unitika Co., Ltd.

<Urethane Resin>

NeoRez™ R-967, R-600, R-9671 manufactured by Kusumoto Chemicals, Ltd.; and W-6061, W-5661, WS-4000 manufactured by Mitsui Chemicals Co., Ltd.

<Acrylic Resin>

NeoCryl™ A-1127 manufactured by Kusumoto Chemicals, Ltd.; Movinyl™ 6899 D, 6696D, 6800, 6810 manufactured by Japan Coating Resin Co., Ltd.; and TOCRYL™ W-7146, W-7150, W-7152 manufactured by Toyochem Co., Ltd.

The content of the resin fine particles in the ink is not particularly limited, but is preferably within a range of 2 to 10% by mass, and more preferably within a range of 2 to 5% by mass.

(Organic Solvent)

As the organic solvent contained in the ink, a water-soluble organic solvent may be suitably used. Examples of the water-soluble organic solvent include alcohols, polyhydric alcohols, amines, amides, glycol ethers, and 1,2-alkanediols having 4 or more carbon atoms.

Examples of the alcohol include methanol, ethanol, 1-propanol, 2-propanol, 1-butanol, 2-butanol, 2-methyl-1-propanol, t-butanol, 3-methoxy-1-butanol, 3-methoxy-3-methylbutanol, 1-octanol, 2-octanol, n-nonyl alcohol, tridecyl alcohol, n-undecyl alcohol, stearyl alcohol, oleyl alcohol, and benzyl alcohol.

Examples of the polyhydric alcohol include ethylene glycol, diethylene glycol, triethylene glycol, tetraethylene glycol, polyethylene glycol having 5 or more number of ethylene oxide groups, propylene glycol, dipropylene glycol, tripropylene glycol, polypropylene glycol having 4 or more number of propylene oxide groups, butylene glycol, hexanediol, pentanediol, glycerin, hexanetriol, and thiodiglycol.

Examples of the amine include ethanolamine, diethanolamine, triethanolamine, N-methyldiethanolamine, N-ethyldiethanolamine, morpholine, N-ethylmorpholine, ethylenediamine, diethylenediamine, triethylenetetramine, tetraethylenepentamine, polyethyleneimine, pentamethyldiethylenetriamine, and tetramethylpropylenediamine.

Examples of the amide include formamide, N,N-dimethylformamide, and N,N-dimethylacetamide.

Examples of the glycol ether include ethylene glycol monoethyl ether, ethylene glycol monobutyl ether, diethylene glycol monoethyl ether, diethylene glycol monobutyl ether, triethylene glycol monobutyl ether, propylene glycol monopropyl ether, dipropylene glycol monomethyl ether, and tripropylene glycol monomethyl ether.

Examples of the 1,2-alkanediol having 4 or more carbon atoms include 1,2-butanediol, 1,2-pentanediol, 1,2-hexanediol, and 1,2-heptanediol.

Particularly preferably used organic solvents are polyhydric alcohols, and bleeding during high-speed printing may be suitably suppressed. Specifically, ethylene glycol, diethylene glycol, triethylene glycol, tetraethylene glycol, propylene glycol, dipropylene glycol, and tripropylene glycol are preferred.

The ink may contain 1 or 2 or more kinds selected from these organic solvents in combination.

The content of the organic solvent in the ink is not particularly limited, but is preferably within a range of 10 to 60% by mass.

(Water)

The water contained in the ink according to the present invention is not particularly limited, and may be ion-exchanged water, distilled water, or pure water. The content of water in the ink is not particularly limited, but is preferably within a range of 45 to 80% by mass.

(Other additives)

The ink according to the present invention may contain various known additives, if necessary, depending on the purpose of improving the surfactant property, the ejection stability, the print head and the ink cartridge compatibility, the storage stability, the image storage property, and other various performances.

<Surfactant>

It is preferable that the ink contains a surfactant, and thereby, it is possible to control an improvement in ink ejection stability and a spreading (dot diameter) of a liquid droplet landed on a recording medium.

The surfactant which may be used in the ink according to the present invention may be used without any particular limitation, but when an anionic compound is contained in other constituent components of the ink, the ionic property of the surfactant is preferable an anion, a nonion or a betaine type.

In the present invention, a fluorine-based or silicone-based surfactant having a high ability of lowering a static surface tension, or an anionic surfactant such as dioctyl sulfosuccinate having a high ability of reducing a dynamic surface tension, a polyoxyethylene alkyl ether having a relatively low molecular weight, a polyoxyethylene alkyl phenyl ether, an acetylene glycol, a pluronic type surfactant (Pluronic™ is a registered trademark), or a nonionic surfactant such as a sorbitan derivative is preferably used. It is also preferable to use a fluorine-based or silicone-based surfactant in combination with a surfactant having a high ability of reducing dynamic surface tension.

By adding a silicone-based or fluorine-based surfactant as a surfactant, ink mixing may be further suppressed for a recording medium made of various hydrophobic resins, including a vinyl chloride sheet, or a recording medium having slow absorption such as a printed book paper, thereby obtaining a printed image with high image quality.

As the above-mentioned silicone-based surfactant, there is preferably a polyether-modified polysiloxane compound, and examples thereof include KF-351A, KF-642 manufactured by Shin-Etsu Chemical Co., Ltd., BYK345, BYK347, BYK348 manufactured by BYK Chemie, and Tegowet™ 260 manufactured by Evonik Industries.

The above-mentioned fluorine-based surfactant means that a part or all of which is substituted with fluorine instead of hydrogen bonded to carbon of a hydrophobic group of an ordinary surfactant. Of these, those having a perfluoroalkyl group in the molecular are preferred.

Among the above-mentioned fluorinated surfactants, some are commercially available under the trade name Megafac™ F from DIC Corporation, under the trade name Surflon™ from AGC Inc., under the trade name Fluorad™ FC from 3M Company, under the trade name Monflor™ from Imperial Chemical Industry, under the trade name Zonyls™ from DuPont Nemeours, Inc., and under the trade name Licowet™ VPF from Farbwerke Hoechist AG.

The content of the surfactant in the ink is not particularly limited, but is preferably within a range of 0.1 to 5.0% by mass.

In the ink used in the present invention, various well-known additives, for example, polysaccharides, viscosity adjusting agents, resistivity adjusting agents, film forming agents, UV absorbers, antioxidants, anti-fading agents, and anti-rust agents may be appropriately selected according to the purpose of improving the ejection stability, the compatibility with the print head and the ink cartridge, the storage stability, the image storage property, and other various performances. Examples thereof include fine particles of oil droplets of liquid paraffin, dioctylphthalate, tricresyl phosphate, and silicone oil; UV absorbers described in JP-A Nos. 57-74193, 57-87988, and 62-261476, 1975, and 1975-1491; anti-fading agents described in JP-A Nos. 57-74192, 57-87989, 60-72785, 61-146591, 1-95091, and 3-13376; and fluorescent whitening agents described in JP-A Nos. 59-42993, 59-52689, 62-28069, 61-242871, and 4-219266.

The ink In used in the present invention preferably has a viscosity of 1 to 40 mPa·s at 25° C., and more preferably 2 to 10 mPa·s. The viscosity of the ink In may be measured with a rotary viscometer. Unless otherwise specified, the viscosity in this specification is a viscosity at 25° C.

Further, it is preferable that the static surface tension of the ink In at 25° C. is larger than that of the processing liquid Pr. The static surface tension of the ink In is preferably in the range of 25 to 33 mN/m at 25° C., more preferably in the range of 25 to 29 mN/m. The static surface tension of the ink In may be measured by a surface tension meter. The static surface tension in this specification is the static surface tension at 25° C. unless otherwise specified.

[Processing Liquid]

The processing liquid Pr according to the present invention contains at least a flocculant. The viscosity of the processing liquid Pr is adjusted by adding a solvent so as to be ejectable from the nozzles on the head 1Pr by an inkjet method. The processing liquid Pr contains a flocculant as an essential component, and further contains water, an organic solvent and a surfactant as a basic component.

Further, it is preferable that the processing liquid Pr does not contain resin fine particles. Since the processing liquid Pr does not contain the resin fine particles, the processing liquid Pr hardly increases in viscosity by drying on the nozzle surface of the head, and there is an effect that the ejection performance of the inkjet becomes good.

The viscosity of the processing liquid Pr is preferably within a range of 1 to 40 mPa·s at 25° C., more preferably within a range of 1 to 10 mPa·s.

The static surface tension of the processing liquid Pr at 25° C. is preferably smaller than the static surface tension of the ink In. The static surface tension of the processing liquid Pr is preferably within a range of 22 to 30 mN/m at 25° C., more preferably within a range of 22 to 26 mN/m.

Further, the dynamic surface tension of the processing liquid Pr is preferably 40 mN/m or less at 25° C. and 50 ms, more preferably 36 mN/m or less, and still more preferably 35 mN/m or less. More preferably, the dynamic surface tension measured under the above conditions is in the range of 25 to 35 mN/m. The dynamic surface tension of the processing liquid Pr may be measured by a dynamic surface tension meter. The dynamic surface tension in this specification is a dynamic surface tension at 25° C. and 50 ms, unless otherwise specified.

(Flocculant)

In the processing liquid according to the present invention, when combined with an ink containing a coloring material, a material that causes an aggregate substance, that is, a flocculant is contained, so that an interaction with an ink becomes large and a dot of an ink is immobilized. Note that the flocculant may be selected according to the type of the coloring material contained in the ink.

The flocculant preferably contains any of a solution cationic polymer having thermal decomposability, an organic acid or a polyvalent metal salt, and more preferably a solution cationic polymer or a polyvalent metal salt.

The above-mentioned solution cationic polymer and polyvalent metal salt may agglomerate an anionic component (usually coloring material, or pigment) in the above-mentioned ink by salting out. The above organic acid is capable of aggregating an anionic component in the above ink by pH variation.

When an organic acid is used, the pH is generally in an acidic range. Therefore, a resin such as an adhesive used in an inkjet head may be deteriorated, and inkjet head resistance may be inferior. The polyvalent metal salt has a pH value from a neutral range to a weak alkali range, and the pH may be adjusted to a neutral range by appropriately selecting an article number for the solution cationic polymer. Therefore, since the above problem may be solved, it is more preferable that the flocculant is a solution cationic polymer or a polyvalent metal salt.

Examples of the above-mentioned solution cationic polymer include polyallylamine, polyvinylamine, polyethyleneimine and polydiallyldimethylammonium chloride. Examples of the commercially available product of the solution cationic polymer include KHE100L, FPA100L manufactured by Senka Corporation, and PAS-92A, PAS-M-1A, PAS-21CL manufactured by Nittobo Medical Co., Ltd.

The above organic acid is one capable of aggregating a pigment which may be contained in an ink, and preferably has a first dissociation constant of 3.5 or less, and preferably within a range of 1.5 to 3.5. When the first dissociation constant is within the above range, liquid deviation in the low density portion of a low printing ratio is further prevented, and beading in the high density portion having a high printing ratio is further improved.

Further, by using an organic acid, the storage stability of the processing liquid is easily maintained, and blocking is hardly caused after the processing liquid is applied and dried. Preferred organic acids from the above viewpoint include formic acid, acetic acid, propionic acid, isobutyric acid, oxalic acid, fumaric acid, malic acid, citric acid, malonic acid, succinic acid, maleic acid, benzoic acid, 2-pyrrolidone-5-carboxylic acid, lactic acid, acrylic acid and derivatives thereof, methacrylic acid and derivatives thereof, compounds having carboxy groups including acrylamide and derivatives thereof, sulfonic acid derivatives, phosphoric acid and derivatives thereof.

The content of the organic acid in the processing liquid Pr may be any amount that adjusts the pH of the processing liquid to less than the first dissociation constant of the organic acid. By including an amount of an organic acid in which the pH of the processing liquid becomes lower than the first dissociation constant of the organic acid in the processing liquid, bleeding at the time of high-speed printing may be effectively suppressed.

Examples of the above polyvalent metal salt include water-soluble salts such as calcium salts, magnesium salts, aluminum salts and zinc salts. Examples of the compound which forms a salt with the polyvalent metal include hydrochloric acid, bromic acid, hydroiodic acid, sulfuric acid, nitric acid, phosphoric acid, thiocyanic acid, and organic carboxylic acids such as acetic acid, oxalic acid, lactic acid, fumaric acid, fumaric acid, citric acid, salicylic acid, and benzoic acid, and organic sulfonic acid.

The flocculant is preferably contained in a range of 5% by mass or less based on the processing liquid, and it is preferable to contain the flocculant within a range of 1 to 4% by mass from the viewpoint of effectively aggregating the anionic component in the ink and balancing the image quality and the hot water resistance.

The content of the flocculant in the processing liquid Pr may be measured by a known method. For example, the content may be measured by ICP emission spectrometry when the flocculant is a polyvalent metal salt, and by high performance liquid chromatography (HPLC) when the flocculant is an acid.

(Water, Organic Solvent and Surfactant)

The water contained in the processing liquid Pr according to the present invention is not particularly limited, and may be ion-exchanged water, distilled water, or pure water. The content of water in the processing liquid Pr is not particularly limited, but is preferably within a range of 45 to 80% by mass.

Further, as a solvent of the processing liquid Pr according to the present invention, an organic solvent may be contained in addition to water. As the organic solvent, the same organic solvent as exemplified in the above ink In may be used. The content of the organic solvent in the processing liquid Pr is not particularly limited, but is preferably within a range of 10 to 50% by mass.

The processing liquid Pr according to the present invention may contain a surfactant. As the surfactant, the same surfactant as exemplified in the above ink In may be used. The content of the surfactant in the processing liquid Pr is not particularly limited, but is preferably within a range of 0.05 to 3% by mass.

In addition, other components such as a crosslinking agent, an anti-mold agent, and a fungicide may be appropriately blended in the processing liquid within a range not impairing the effect of the present invention.

Further, for example, the following may be contained: ultraviolet absorbers described in JP-A Nos. 57-74193, 57-87988 and 62-261476; anti-fading agents described in JP-A Nos. 57-74192, 57-87989, 60-72785, 61-146591, 1-95091, and 3-13376; various anionic, cationic or nonionic surfactants; fluorescent whitening agents described in JP-A Nos. 59-42993, 59-52689, 62-280069, 61-242871 and 4-219266; and various known additives such as anti-foaming agents, lubricants such as diethylene glycol, preservatives, thickener, and antistatic agents.

(Recording Medium)

The recording medium which may be used in the present invention is not particularly limited, but is preferably a recording medium made of a non-absorbent material (hereinafter also referred to as "non-absorbent recording medium"). By using a non-absorbent recording medium, the effect of the present invention is more remarkable. In the present invention, "non-absorbent" represents "non-absorbent to water".

As an example of the non-absorbent recording medium, a film of a known plastic may be used. Specific examples thereof include polyester films such as polyethylene terephthalate, polyethylene films, polypropylene films, polyamide-based films such as nylon, polystyrene films, polyvinyl chloride films, polycarbonate films, polyacrylonitrile films, and biodegradable films such as polylactic acid films. In addition, in order to impart gas barrier property, moisture barrier property, and flavor retention, a film obtained by coating one or both sides of a film with polyvinylidene chloride or a film obtained by vapor-depositing a metal oxide may be preferably used. The non-absorbent film may be preferably used either as an unstretched film or as a stretched film.

In addition to these, a recording medium made of an inorganic compound such as a metal or glass may be mentioned as a non-absorbent recording medium.

Further, a packaging material for retort food may be suitably used in which a thermosetting resin is provided as a coating layer on a metal recording medium. In order to block air, moisture and light and seal the food inside, the packaging material for retort food is, for example, composed of a film in which a thermoplastic resin layer and an aluminum foil layer are laminated to seal the material. It is composed of a polypropylene film on the food side and a polyester film on the outside to block air, moisture and light and seal the food inside.

Examples of the non-absorbent recording medium include a leather base material. Leather used in printing applications is typically cowhide. Cowhide is usually tanned with a chromium compound to add durability. It is common to apply an acrylic or urethane-based white pigment coating to tanned leather to form a recording medium.

In the present invention, the thickness of the recording medium is appropriately selected according to the type of the recording medium. When the recording medium is a plastic film, the thickness of the recording medium is preferably within a range of 10 to 120 μm, more preferably 12 to 60 μm. When the recording medium is a metal recording medium, the thickness of the recording medium is preferably within a range of 0.05 to 0.5 mm, more preferably 0.1 to 0.3 mm. When the recording medium is a leather base material, the thickness of the recording medium is preferably within a range of 1 to 5 mm, more preferably 1 to 3 mm.

[Recording Apparatus of the Present Invention]

The recording apparatus of the present invention is a recording apparatus using an ink containing at least a coloring material and a processing liquid containing at least a flocculent, and this recording apparatus is provided with a droplet discharge device having at least one or more discharge ports for discharging the ink and at least one or more discharge ports for discharging the processing liquid. This recording apparatus forms an image by applying droplets of the ink and droplets of the processing liquid to a surface of a recording medium from the droplet discharge devices and coalescing them. The relationship between the amount of the ink applied and the amount of the processing liquid applied is controlled as described in the conditions (1) and (2) above.

As an ink containing at least a coloring material and a processing liquid containing at least a flocculant used in the recording apparatus of the present invention, the same ink In and the same processing liquid Pr described in the recording method of the present invention described above may be used. The recording apparatus of the present invention may be used without any particular limitation as long as it is a two-liquid type inkjet recording apparatus capable of controlling the relationship between the application amount of the ink In and the application amount of the processing liquid Pr as described in the conditions (1) and (2) above.

The two-liquid type inkjet recording apparatus used has a droplet discharge device having one or more discharge ports for discharging the ink In and one or more discharge ports for discharging the processing liquid Pr, and further has, for example, a control unit for controlling the application amount of the ink In and the application amount of the processing liquid Pr in the droplet discharge device. In such a two-liquid type inkjet recording apparatus, the recording apparatus of the present invention may be obtained by introducing a program for controlling the amount of the ink In to be applied and the amount of processing liquid Pr to be applied to the control unit as described in the conditions (1) and (2).

Further, by incorporating the above-mentioned various preferable control conditions in the program to be introduced into the control unit, a recording apparatus capable of a more preferable mode of the recording method of the present invention becomes possible. In particular, it is preferable that the program incorporates a program for applying the processing liquid to the image forming region where the image is formed and the peripheral region of the image forming region, and controlling the application amount of the processing liquid to be applied to the peripheral region of the image forming region to be the same amount as the application amount of the processing liquid at the end portion of the image forming region.

As the recording apparatus of the present invention, the droplet discharge device may be either a scanning method or a line method. Regarding a recording apparatus in which a droplet discharge device is a scanning system, a recording apparatus in which a main part is shown in FIG. 1 was already exemplified. In the above explanation, the droplet discharge device 20 has the head 1Pr for the processing liquid and the heads 1Y, 1M, 1C and 1K corresponding to the inks of the respective colors, and each head has a plurality of nozzles. In the droplet discharge device 20, the nozzles correspond to discharge ports, and minute droplets are discharged from the nozzles by appropriately applying pressure to the ink and the processing liquid.

When the droplet discharge device is of the line type, the droplet discharge device has a length equal to or greater than the print area width PW of the entire print area P with respect to the recording medium M, and the head 1Y, 1M, 1C and 1K corresponding to the head 1Pr for the processing liquid and the ink of each color are arranged in order along the conveying direction Y so as to be parallel to the print area width PW. The head 1Pr for the processing liquid may be disposed in front of or after the heads of the inks of the respective colors.

In the droplet discharge device of the line type, one head unit 1 (a set of the head 1Pr and the head 1Y, 1M, 1C, and 1K) may be used to be equal to or larger than the print area width PW, or a plurality of head units 1 may be combined to be equal to or larger than the print area width PW.

Further, the plurality of head units 1 may be arranged so that the nozzles of each other are staggered, and the resolution of the droplet discharge device may be increased as a whole of the heads. In addition, a plurality of such droplet discharge device may be arranged in parallel along the conveying direction Y of the recording medium. In this case, the number of printing passes according to the control condition (2) corresponds to the number of head units 1 arranged side by side along the conveying direction Y.

The system of each head is not particularly limited, and any one of the on-demand system and the continuous system may be used. Examples of on-demand heads include electro-mechanical conversion methods including single cavity type, double cavity type, bender type, piston type, share mode type and share wall type, as well as electrical-thermal conversion methods including thermal inkjet type and bubble jet type ("Bubble jet" is registered trademark of Canon Inc.).

Among the above heads, it is preferable to be a head using a piezoelectric element as an electro-mechanical conversion element used in the electro-mechanical conversion method (also referred to as a "piezo-type inkjet head").

EXAMPLES

Hereinafter, the present invention will be specifically described with reference to Examples, but the present invention is not limited thereto. In the examples, "parts" or "%" is used, but unless otherwise specified, it represents "parts by mass" or "% by mass". Further, "% by mass" may de indicated as "mass %".

[Preparation of Ink]

Each of the components shown in Table I was mixed with the composition shown in Table I to prepare a cyan ink. Physical properties are also shown in Table I. A yellow ink, a magenta ink, and a black ink were prepared in the same manner as in Table I, except that the pigment shown in Table I was changed to Pigment Yellow 155, a 1:1 (mass ratio) mixture of Pigment Red 202 and Pigment Violet 19, and Pigment Black 7, respectively. The physical properties of these inks were the same as those of the cyan ink shown in Table I. A set of the obtained cyan ink, magenta ink, yellow ink, and black ink was used as an ink set A in the following examples.

TABLE I

| Ink type | | | A |
|---|---|---|---|
| Composition | Pigment | Pigment Blue 15:3 | 5 mass % |
| | Polymer dispersant | Joncryl 819 (BASF) | 2 mass % |
| | Neutralizing agent | N-Methyldiethanolamine | 0.4 mass % |
| | Resin fine particles | NeoCryl A-1127 (Kusumoto Chemicals) | 5 mass % |
| | Organic solvent | Propylene glycol | 30 mass % |
| | Surfactant | KF-351A (Shin-Etsu Chemical) | 0.5 mass % |
| | | Water | Remaining amount |
| Physical property | Viscosity | mPa · s | 5.12 |
| | Static surface tension | mN/m | 28.7 |

[Preparation of Processing Liquid]

Each of the components shown in Table II was mixed with the composition shown in Table II to prepare 3 types of processing liquids A, B and C. The physical properties of each processing liquid are also shown in Table II.

TABLE II

| Processing liquid type | | | A | B | C |
|---|---|---|---|---|---|
| Composition | Polyvalent metal salt | Calcium acetate | 3 mass % | 3 mass % | 3 mass % |
| | Ink solvent | Propylene glycol | 30 mass % | 30 mass % | 30 mass % |
| | Surfactant | KF-351A (Shin-Etsu Chemical) | 0.5 mass % | 1 mass % | — |
| | | Tegowet (Evonik) | — | — | 1 mass % |
| | | Water | Remaining amount | Remaining amount | Remaining amount |
| Physical property | Viscosity | mPa · s | 4.89 | 5.02 | 5.09 |
| | Static surface tension | mN/m | 28.8 | 26.7 | 25.5 |
| | Dynamic surface tension | mN/m | 38.3 | 35.6 | 32.1 |

Examples 1 to 12, Comparative Examples 1 to 3

An independently driven inkjet head (360 dpi, discharge amount: 7 pL, 15 pL, 23 pL; corresponding to the droplet discharge device 20 in FIG. 1) manufactured by Konica Minolta Inc. was installed as shown in FIG. 1, and by moving the head unit 1 in the scanning direction X and the recording medium M in the conveying direction Y, the inks and the processing liquids of respective colors were applied to the surface (image forming surface) of the recording medium M to form an image.

The moving speed of the head unit 1 was set to 500 mm/sec. The image of 720 dpi×720 dpi was divided into four images (180 dpi×180 dpi) divided into two in each of the scanning direction X and the conveying direction Y, and one print area was printed four times to form an image.

After printing by the inkjet method, the recording medium was put into a dryer, and dried at each set temperature for 10 minutes to obtain an image recording product.

As the original image 1, an image of a gradation chart from low density to high density shown in FIG. 7 was prepared. Here, for C, M, Y, and K, the densities are in the range of 0 to 100% shown on the scale in FIG. 7, and for R, G, and B, the densities are in the range of 0 to 200% which is doubled from that.

Figure 8:
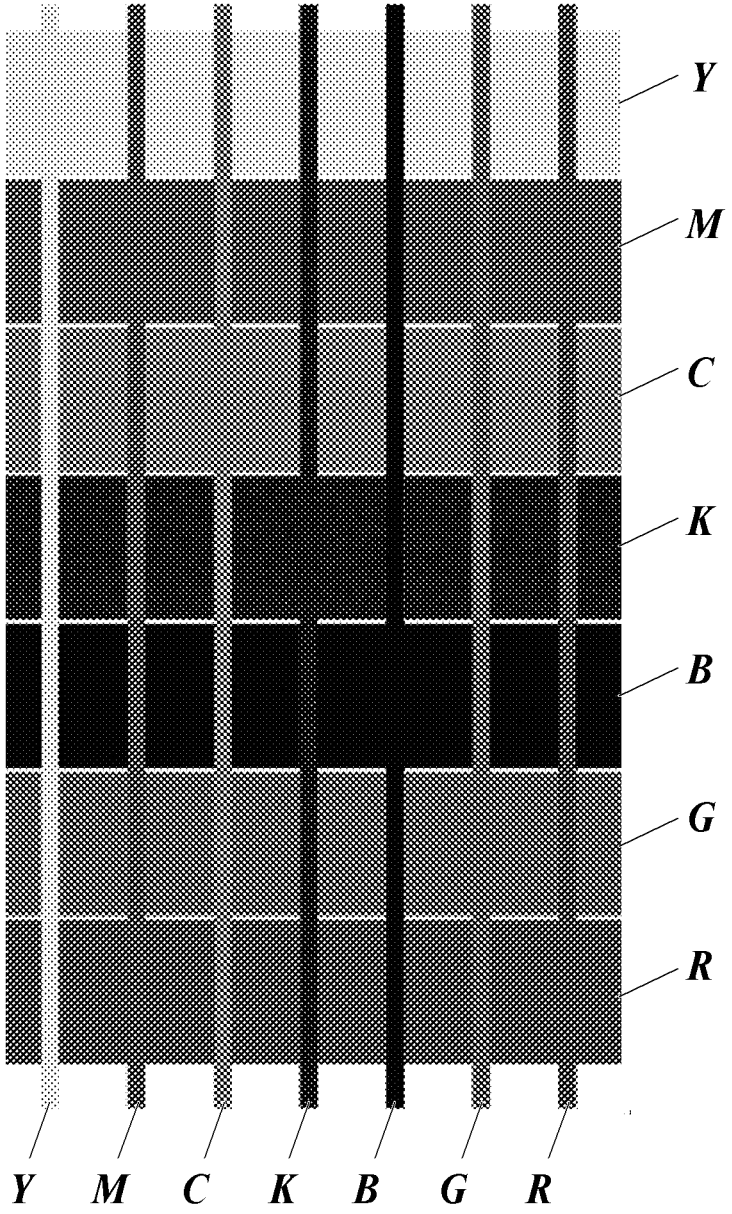
FIG. 8 is a diagram illustrating a document image 2 used in the recording method of the example.

As the original image 2, an evaluation image was prepared in which solid images of C, M, Y, K, R, G, and B shown in FIG. 8 were arranged so as to be adjacent to each other.

As the original image 3, an image was prepared in which a 6 pt outline character was drawn on a solid image (high density image, medium-high density image, medium density image, medium-low density image, and low density image) of each color of C, M, Y, K, R, G, and B.

For each Example and Comparative Example, image formation was performed on a recording medium using document images 1 to 3, and the following evaluations were performed. As the recording medium, a polyester film (FE2001, thickness: 50 micrometers, manufactured by Futamura Chemical Co., Ltd.) was used.

Table III to V shows the type of the ink and the processing liquid used, and the condition of the application amount of the ink and the processing liquid, in Examples 1 to 12 and Comparative Examples 1 to 3. In any of the above examples, the unit area U in the image forming region is set to 4 pixels made of 2×2 pixels.

In the table, the high density, medium-high density, medium density, medium-low density, and low density are the densities (100%, 80%, 60%, 40%, and 20%) relative to the maximum density obtained by dividing 100 to 0% by 5 for C, M, Y, and K. For R, G and B, these are the densities (200%, 160%, 120%, 80%, 40%) relative to the maximum density of the doubled 200 to 0% divided by 5.

In the table, "the maximum value (%) of the deviation (absolute value) when the amount of the processing liquid applied for each printing pass is compared" is a value determined as follows in each density (high density, medium-high density, medium density, medium-low density, and low density), respectively. That is, in each of the first to fourth printing passes, the average value of the divided application amounts of the processing liquid Pr is calculated. The deviation (%) is calculated for each printing pass by using the average value in each printing pass. The maximum of the absolute values of the deviation of each print pass was determined and is shown in the table.

In the table, the "maximum value (%) of the deviation (absolute value) when the application amount of the processing liquid for each printing pass is compared" when the image in the print area is a uniform density is shown. From the table, it can be seen that the deviation of the divided application amount of the processing liquid Pr between the four printing passes is within ±30% in any of the cases where the application amount of the processing liquid Pr is equal to or greater than 0.8 g/m$^2$ in the print areas where the density of the images is uniform. From this result, for example, even in the case where there is a shade in the image, it may be estimated that the deviation of the average value of the divided application amounts for each printing pass in the unit area in which the application amount of the processing liquid Pr is equal to or greater than 0.8 g/m$^2$ is within ±30% when the average value of the divided application amounts is compared between the four printing passes.

In practice, the amount of the processing liquid Pr to be applied is determined according to the density of the image in the printing region, that is, it is determined according to the amount of the ink In to be applied. The above calculations are performed by averaging the divided application amounts for each print pass in the unit areas in which the application amount of the processing liquid Pr is equal to or greater than 0.8 g/m$^2$. The table shows the maximum value (%) of the absolute value as a result of calculating the deviation of the obtained average value of four times by calculating the average value of the divided application amounts for each printing pass for the unit area U in which the application amount of the processing liquid Pr is 0.8 g/m$^2$ or more as a "deviation between printing passes in unit areas in which the application amount of the processing liquid Pr is 0.8 g/m$^2$ or more". For example, in CMYK image of Example 1, an average value of the divided application amounts of the processing liquid in all unit areas U of high density, medium-high density, medium density, and medium-low density is determined for each printing pass, and a deviation in an average value for each printing pass is calculated, and a maximum value (%) of an absolute value of the deviation is shown in the table.

In the table, "CMYK image" in the column of dot arrangement of the processing liquid image indicates that the dot arrangement position of the processing liquid is basically arranged at the same position as the dot arrangement position of CMYK image, and for the unit area where the amount of the processing liquid applied in the unit area is 0.8 g/m$^2$ or more and 5 g/m$^2$ or less, it is shown that the average value and the deviation of the applied amount of the processing liquid of the image divided into four are controlled and arranged so as to be a predetermined value. The "error diffusion method" indicates that the processing liquid was arranged by the error diffusion method.

In the table, "present" in the column of the boundary vicinity correction between the print areas indicates that a range from the boundary between the print areas to 0.105 mm (corresponding to three pixels at 720×720 dpi) inside each print area is set in the vicinity of the boundary, and the amount of the processing liquid in the range is increased to 175% of the amount of the processing liquid in the area other than the vicinity of the boundary.

In the table, regarding the presence or absence of the processing liquid applied to the peripheral region and the width of the peripheral region to which the processing liquid is applied, the presence or absence of the processing liquid applied to the peripheral region of the image forming region corresponding to the original image 3 is indicated, and when it is present, the width of the peripheral region to which the processing liquid is applied is indicated. Note that the amount of the processing liquid applied to the peripheral region was set to be the same as the amount of the processing liquid applied at the end of the image forming region adjacent to the peripheral region. The contour of the image forming region is an outline obtained by performing an image process on the document image 3 by Canny method. In Example 9, the processing liquid was applied to the peripheral region only when the applied amount of the ink exceeded 15 g/m$^2$.

Figure 11:
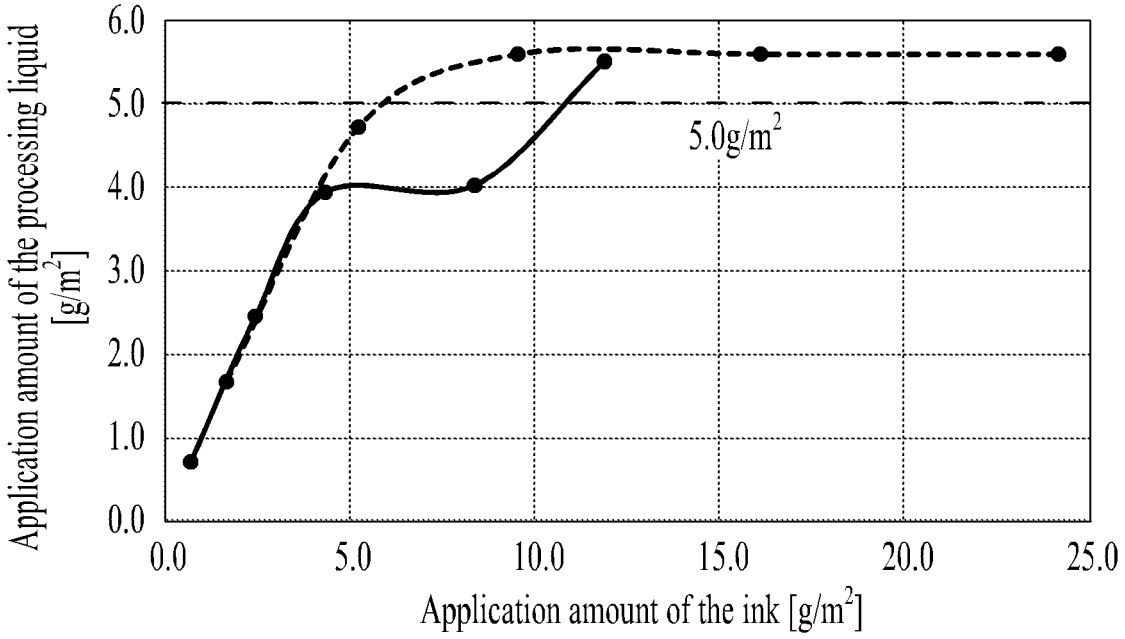
FIG. 11 is a graph showing the relationship between the application amount of the ink In and the application amount of the processing liquid Pr in Comparative Example 1.
Figure 12:
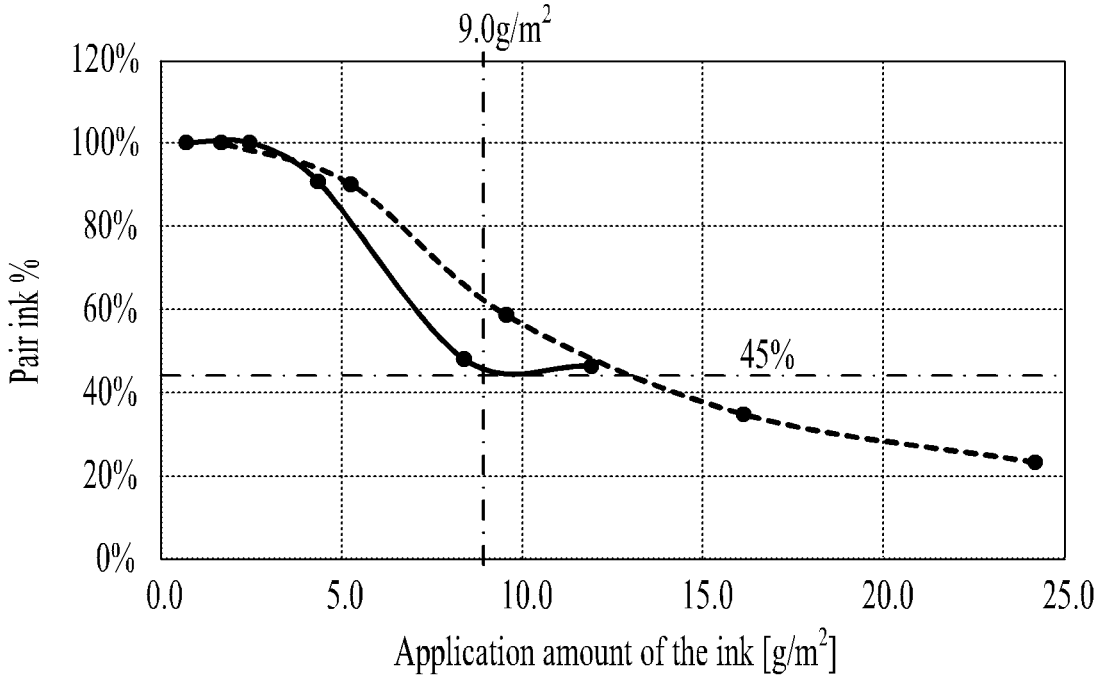
FIG. 12 is a graph showing the relationship of the ratio (%) between the application amount of the ink In and the application amount of the processing liquid Pr in Comparative Example 1.
Figure 13:
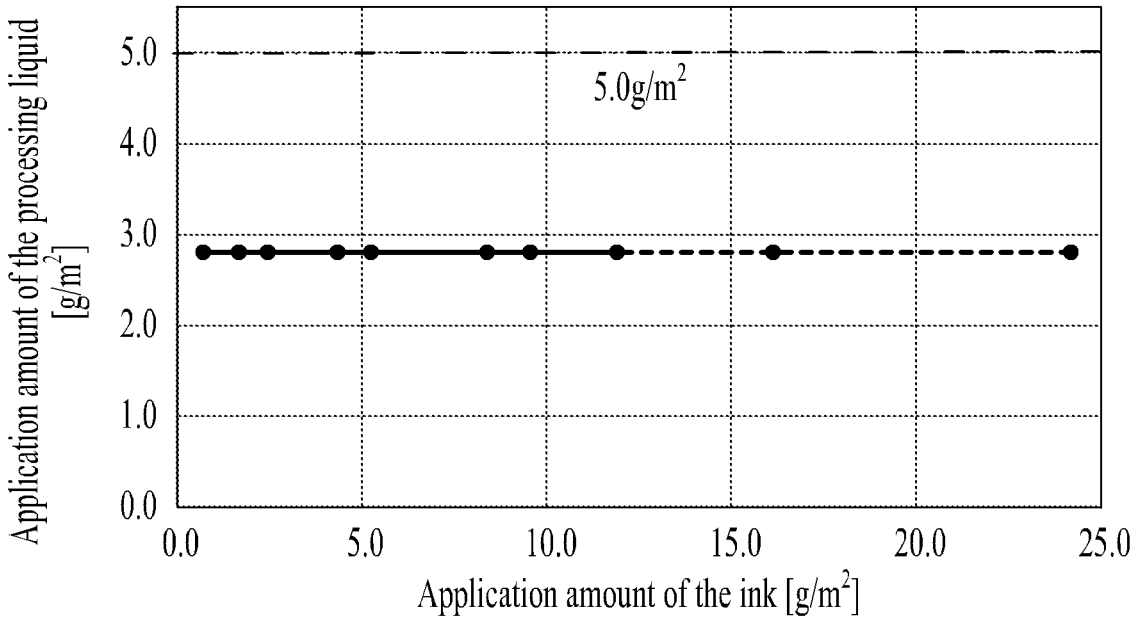
FIG. 13 is a graph showing the relationship between the application amount of the ink In and the application amount of the processing liquid Pr in Comparative Example 2.
Figure 14:
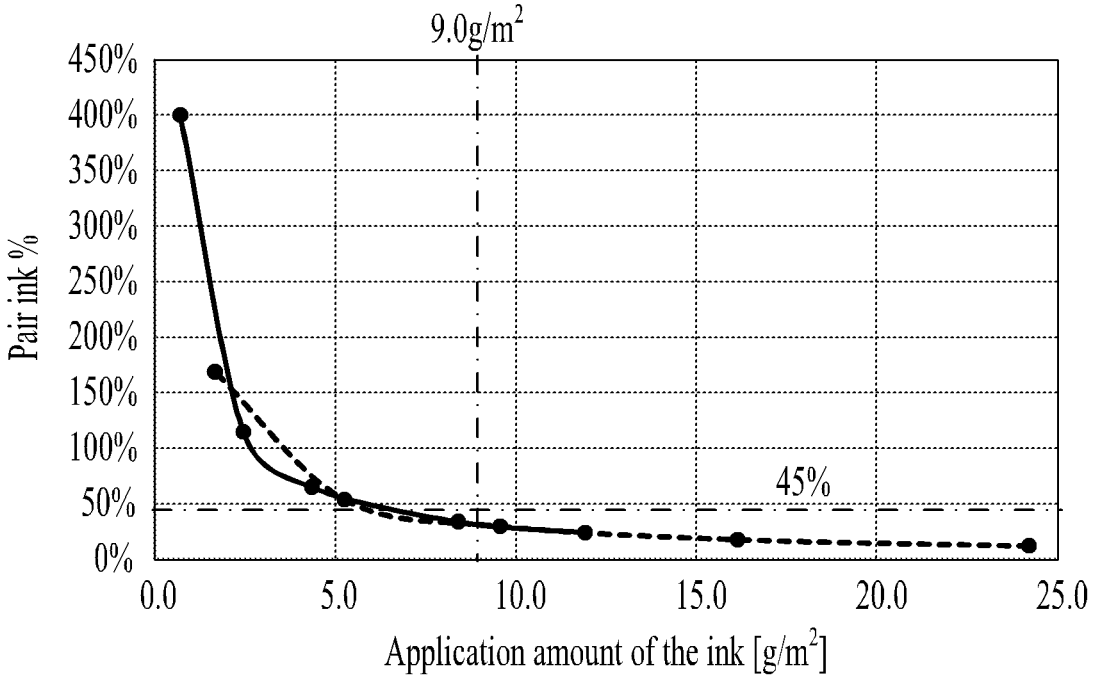
FIG. 14 is a graph showing the relationship of the ratio (%) between the application amount of the ink In and the application amount of the processing liquid Pr in Comparative Example 2.

FIG. 9 and FIG. 10 show a graph showing the relationship between the amount of the ink In applied and the amount of processing liquid Pr applied in Example 1, and a graph showing the relationship of the ratio (%) between the amount of the ink In added and of the amount of processing liquid Pr applied to the amount of the ink In applied. FIG. 11 and FIG. 12 show a graph showing the relationship between the amount of the ink In applied and the amount of processing liquid Pr applied in Comparative Example 1, and a graph showing the relationship of the ratio (%) between the amount of the ink In added and the amount of processing liquid Pr applied to the amount of the ink In applied. FIG. 13 and FIG. 14 show a graph showing the relationship between the amount of the ink In applied and the amount of processing liquid Pr applied in Comparative Example 2, and a graph showing the relationship of the ratio (%) between the amount of the ink In applied and the amount of processing liquid Pr applied to the amount of the ink In applied. In each graph, the solid line is a graph in the case of CMYK, the dashed line is a graph in the case of RGB. In addition, in Tables III to V, the evaluation results in the following evaluations are also shown.

<Crack>

The image quality of the high density region of the image formed corresponding to the original image 1 was visually confirmed, and the crack was evaluated by the following criteria.

(Evaluation Criteria)

1: No cracks or unevenness is seen.

2: There are slight cracks and unevenness, but they are not noticeable.

3: Both cracks and unevenness are noticeable.

<Granularity>

The image quality of the low to medium density region of the image formed corresponding to the original image 1 was visually confirmed, and the granularity was evaluated according to the following criteria.

(Evaluation Criteria)

1: No granularity is seen.

2: Slight granularity is seen but not noticeable.

3: Granularity is noticeable.

<Color Bleeding>

With respect to the image formed corresponding to the original image 2, bleeding between colors was visually confirmed, and color bleeding was evaluated by the following criteria.

(Evaluation Criteria)

1: No color bleeding is seen.

2: A slight color bleeding is seen but not noticeable.

3: Color bleeding is noticeable.

<Ink Bleeding at the End Portion of the Image Forming Region>

The image quality of the outline characters was visually confirmed with respect to the image formed corresponding to the original image 3, and the degree of bleeding of the ink was evaluated based on the following criteria.

(Evaluation Criteria)

1: Bleeding and unevenness are not observed.

2: Slight bleeding and unevenness are observed but not noticeable.

3: Bleeding and unevenness are noticeable.

TABLE III

| | | | | Example 1 | | Example 2 | | Example 3 | | Comparative Example 1 |
|---|---|---|---|---|---|---|---|---|---|---|
| | | | Unit | CMYK | RGB | CMYK | RGB | CMYK | RGB | CMYK |
| Printing condition | Average value of the application amounts of the ink | High density | g/m$^2$ | 11.9 | 24.2 | 11.9 | 24.2 | 11.9 | 24.2 | 11.9 |
| | | Medium-high density | g/m$^2$ | 8.4 | 16.1 | 8.4 | 16.1 | 8.4 | 16.1 | 8.4 |
| | | Mediumdensity | g/m$^2$ | 4.3 | 9.6 | 4.3 | 9.6 | 4.3 | 9.6 | 4.3 |
| | | Medium-low density | g/m$^2$ | 2.5 | 5.3 | 2.5 | 5.3 | 2.5 | 5.3 | 2.5 |
| | | Low density | g/m$^2$ | 0.7 | 1.7 | 0.7 | 1.7 | 0.7 | 1.7 | 0.7 |
| | Average value of the application amounts of the processing liquid | High density | g/m$^2$ | 2.8 | 2.8 | 1.4 | 1.4 | 4.2 | 4.2 | 5.5 |
| | | Medium-high density | g/m$^2$ | 2.8 | 2.8 | 1.4 | 1.4 | 3.8 | 4.2 | 4.0 |
| | | Medium density | g/m$^2$ | 2.7 | 2.8 | 1.4 | 1.4 | 3.7 | 4.2 | 3.9 |
| | | Medium-low density | g/m$^2$ | 1.9 | 2.8 | 1.4 | 1.4 | 1.9 | 3.9 | 2.5 |
| | | Low density | g/m$^2$ | 0.7 | 1.4 | 0.5 | 1.2 | 0.7 | 1.4 | 0.7 |
| | Ratio of the application amount of the processing liquid to the application amount of the ink | High density | % | 24% | 12% | 12% | 6% | 35% | 17% | 46% |
| | | Medium-high density | % | 33% | 17% | 17% | 9% | 45% | 26% | 48% |
| | | Medium density | % | 62% | 29% | 32% | 15% | 85% | 44% | 91% |
| | | Medium-low density | % | 79% | 53% | 57% | 27% | 79% | 73% | 100% |
| | | Low density | % | 100% | 84% | 75% | 74% | 100% | 84% | 100% |
| | Maximum value (%) of the deviation (absolute value) when the application amount of the processing liquid for each printing pass is compared | High density | % | 0.0 | 0.0 | 0.0 | 0.0 | 0.0 | 0.0 | 4.8 |
| | | Medium-high density | % | 0.0 | 0.0 | 0.0 | 0.0 | 7.0 | 0.0 | 13.0 |
| | | Medium density | % | 9.7 | 0.0 | 0.0 | 0.0 | 4.8 | 0.0 | 11.1 |
| | | Medium-low density | % | 27.3 | 0.0 | 0.0 | 0.0 | 27.3 | 9.1 | 42.9 |
| | | Low density | % | 50.0 | 25.0 | 100.0 | 14.3 | 50.0 | 25.0 | 50.0 |
| | Deviation (%) between printing passesin unit area in which the application amount of the processing liquid Pr is 0.8 g/m$^2$ or more | | | 4.9 | | 7.6 | | 0.8 | | 2.2 |
| | Dot arrangement of the processing liquid image | | | CMYK Image | | CMYK Image | | CMYK Image | | CMYK Image |
| | Boundary vicinity correction between the printing areas | | | Absent | | Absent | | Absent | | Absent |
| | Landing time of the processing liquid and the ink (maximum) | | sec | 1 | | 1 | | 1 | | 1 |
| | Present or absent of the processing liquid applied to the peripheral region | | | Absent | | Absent | | Absent | | Absent |
| | Width of the peripheral region to which the processing liquid is applied | | mm | — | | — | | — | | — |

TABLE III-continued

| | | | | | | | | | |
|---|---|---|---|---|---|---|---|---|---|
| Ink set | | | A | | A | | A | | A |
| Processing liquid | | | A | | A | | A | | A |
| Evaluation | Crack | | 2 | 1 | 1 | 1 | 2 | 2 | 3 |
| | Granularity | | 2 | 2 | 2 | 2 | 2 | 2 | 2 |
| | Color bleeding | | 1 | 2 | 2 | 2 | 1 | 1 | 1 |
| | Quality of outline character | High density | 1 | 2 | 1 | 2 | 1 | 2 | 1 |
| | | Medium-high density | 1 | 2 | 1 | 2 | 1 | 2 | 1 |
| | | Medium density | 1 | 1 | 1 | 1 | 1 | 1 | 1 |
| | | Medium-low density | 1 | 1 | 1 | 1 | 1 | 1 | 1 |
| | | Low density | 1 | 1 | 1 | 1 | 1 | 1 | 1 |

| | | | | Comparative Example 1 | Comparative Example 2 | | Comparative Example 3 | |
|---|---|---|---|---|---|---|---|---|
| | | | Unit | RGB | CMYK | RGB | CMYK | RGB |
| Printing condition | Average value of the application amounts of the ink | High density | $g/m^2$ | 24.2 | 11.9 | 24.2 | 11.9 | 24.2 |
| | | Medium-high density | $g/m^2$ | 16.1 | 8.4 | 16.1 | 8.4 | 16.1 |
| | | Medium density | $g/m^2$ | 9.6 | 4.3 | 9.6 | 4.3 | 9.6 |
| | | Medium-low density | $g/m^2$ | 5.3 | 2.5 | 5.3 | 2.5 | 5.3 |
| | | Low density | $g/m^2$ | 1.7 | 0.7 | 1.7 | 0.7 | 1.7 |
| | Average value of the application amounts of the processing liquid | High density | $g/m^2$ | 5.6 | 2.8 | 2.8 | 2.8 | 2.8 |
| | | Medium-high density | $g/m^2$ | 5.6 | 2.8 | 2.8 | 2.8 | 2.8 |
| | | Medium density | $g/m^2$ | 5.6 | 2.8 | 2.8 | 2.7 | 2.8 |
| | | Medium-low density | $g/m^2$ | 4.7 | 2.8 | 2.8 | 1.9 | 2.8 |
| | | Low density | $g/m^2$ | 1.7 | 2.8 | 2.8 | 0.7 | 1.4 |
| | Ratio of the application amount of the processing liquid to the application amount of the ink | High density | % | 23% | 24% | 12% | 24% | 12% |
| | | Medium-high density | % | 35% | 33% | 17% | 33% | 17% |
| | | Medium density | % | 59% | 64% | 29% | 62% | 29% |
| | | Medium-low density | % | 90% | 114% | 53% | 79% | 53% |
| | | Low density | % | 100% | 400% | 168% | 100% | 84% |
| | Maximum value (%) of the deviation (absolute value) when the application amount of the processing liquid for each printing pass is compared | High density | % | 0.0 | 0.0 | 0.0 | 34.0 | 34.0 |
| | | Medium-high density | % | 0.0 | 0.0 | 0.0 | 34.0 | 34.0 |
| | | Medium density | % | 0.0 | 0.0 | 0.0 | 41.0 | 34.0 |
| | | Medium-low density | % | 11.9 | 0.0 | 0.0 | 38.0 | 34.0 |
| | | Low density | % | 36.8 | 0.0 | 0.0 | 71.8 | 67.5 |
| | Deviation (%) between printing passes in unit area in which the application amount of the processing liquid Pr is 0.8 $g/m^2$ or more | | | 2.2 | 0.0 | | 35.6 | |
| | Dot arrangement of the processing liquid image | | | CMYK Image | CMYK Image | | CMYK Image | |
| | Boundary vicinity correction between the printing areas | | | Absent | Absent | | Absent | |
| | Landing time of the processing liquid and the ink (maximum) | | sec | 1 | 1 | | 1 | |
| | Present or absent of the processing liquid applied to the peripheral region | | | Absent | Absent | | Absent | |
| | Width of the peripheral region to which the processing liquid is applied | | mm | — | — | | — | |
| Ink set | | | | | A | | A | |
| Processing liquid | | | | | A | | A | |
| Evaluation | Crack | | | 3 | 2 | 1 | 2 | 1 |
| | Granularity | | | 2 | 3 | 3 | 2 | 2 |
| | Color bleeding | | | 2 | 1 | 2 | 3 | 3 |
| | Quality of outline character | High density | | 2 | 1 | 2 | 1 | 2 |
| | | Medium-high density | | 2 | 1 | 2 | 1 | 2 |
| | | Medium density | | 1 | 1 | 1 | 1 | 1 |
| | | Medium-low density | | 1 | 1 | 1 | 1 | 1 |
| | | Low density | | 1 | 1 | 1 | 1 | 1 |

TABLE IV

| | | | | Example 4 | | Example 5 | | Example 6 | | Example 7 | |
|---|---|---|---|---|---|---|---|---|---|---|---|
| | | | Unit | CMYK | RGB | CMYK | RGB | CMYK | 1 RGB | CMYK 1 | RGB |
| Printing condition | Average value or the application amounts of the ink | High density | $g/m^2$ | 11.9 | 24.2 | 11.9 | 24.2 | 11.9 | 24.2 | 11.9 | 24.2 |
| | | Medium-high density | $g/m^2$ | 8.4 | 16.1 | 8.4 | 16.1 | 8.4 | 16.1 | 8.4 | 16.1 |
| | | Medium density | $g/m^2$ | 4.3 | 9.6 | 4.3 | 9.6 | 4.3 | 9.6 | 4.3 | 9.6 |
| | | Medium-low density | $g/m^2$ | 2.5 | 5.3 | 2.5 | 5.3 | 2.5 | 5.3 | 2.5 | 5.3 |
| | | Low density | $g/m^2$ | 0.7 | 1.7 | 0.7 | 1.7 | 0.7 | 1.7 | 0.7 | 1.7 |
| | Average value of the application amounts of the processing liquid | High density | $g/m^2$ | 2.8 | 2.8 | 2.8 | 2.8 | 2.8 | 2.8 | 2.8 | 2.8 |
| | | Medium-high density | $g/m^2$ | 2.8 | 2.8 | 2.8 | 2.8 | 2.8 | 2.8 | 2.8 | 2.8 |
| | | Medium density | $g/m^2$ | 2.7 | 2.8 | 2.7 | 2.8 | 2.7 | 2.8 | 2.7 | 2.8 |
| | | Medium-low density | $g/m^2$ | 1.9 | 2.8 | 1.9 | 2.8 | 1.9 | 2.8 | 1.9 | 2.8 |
| | | Low density | $g/m^2$ | 0.0 | 1.4 | 0.7 | 1.4 | 0.7 | 1.4 | 0.7 | 1.4 |

TABLE IV-continued

| | | | Unit | Example 4 | | Example 5 | | Example 6 | | Example 7 | |
|---|---|---|---|---|---|---|---|---|---|---|---|
| | | | | CMYK | RGB | CMYK | RGB | CMYK | 1 RGB | CMYK 1 | RGB |
| | Ratio of the application amount of the processing liquid to the application amount of the ink | High density | % | 24% | 12% | 24% | 12% | 24% | 12% | 24% | 12% |
| | | Medium-high density | % | 33% | 17% | 33% | 17% | 33% | 17% | 33% | 17% |
| | | Medium density | % | 62% | 29% | 62% | 29% | 62% | 29% | 62% | 29% |
| | | Medium-low density | % | 78% | 53% | 79% | 53% | 79% | 53% | 79% | 53% |
| | | Low density | % | 0% | 84% | 100% | 84% | 100% | 84% | 100% | 84% |
| | Maximum value (%) of the deviation (absolute value) when the application amount of the processing liquid for each printing pass is compared | High density | % | 0.0 | 0.0 | 0.0 | 0.0 | 0.0 | 0.0 | 0.0 | 0.0 |
| | | Medium-high density | % | 0.0 | 0.0 | 0.0 | 0.0 | 0.0 | 0.0 | 0.0 | 0.0 |
| | | Medium density | % | 9.7 | 0.0 | 9.7 | 0.0 | 9.7 | 0.0 | 9.7 | 0.0 |
| | | Medium-low density | % | 27.3 | 0.0 | 27.3 | 0.0 | 27.3 | 0.0 | 27.3 | 0.0 |
| | | Low density | % | — | 25.0 | 50.0 | 25.0 | 50.0 | 25.0 | 50.0 | 25.0 |
| | Deviation (%) between printing passes in unit area in which the application amount of the processing liquid Pr is 0.8 g/m$^2$ or more | | | 4.9 | | 4.9 | | 4.9 | | 4.9 | |
| | Dot arrangement of the processing liquid image | | | CMYK Image | | Error diffusion method | | CMYK Image | | CMYK Image | |
| | Boundary vicinity correction between the printing areas | | | Absent | | Absent | | Present | | Absent | |
| | Landing time of the processing liquid and the ink (maximum) | | sec | 1 | | 1 | | 1 | | 0.6 | |
| | Present or absent of the processing liquid applied to the peripheral region | | | Absent | | Absent | | Absent | | Absent | |
| | Width of the peripheral region to which the processing liquid is applied | | mm | — | | — | | — | | — | |
| Ink set | | | | A | | A | | A | | A | |
| Processing liquid | | | | A | | A | | A | | A | |
| Evaluation | Crack | | | 2 | 1 | 1 | 1 | 2 | 1 | 2 | 1 |
| | Granularity | | | 1 | 1 | 2 | 2 | 2 | 2 | 2 | 2 |
| | Color bleeding | | | 1 | 2 | 1 | 2 | 1 | 1 | 1 | 1 |
| | Quality of outline character | High density | | 1 | 2 | 1 | 2 | 1 | 2 | 1 | 2 |
| | | Medium-high density | | 1 | 2 | 1 | 2 | 1 | 2 | 1 | 2 |
| | | Medium density | | 1 | 1 | 1 | 1 | 1 | 1 | 1 | 1 |
| | | Medium-low density | | 1 | 1 | 1 | 1 | 1 | 1 | 1 | 1 |
| | | Low density | | 1 | 1 | 1 | 1 | 1 | 1 | 1 | 1 |

| | | | Unit | Example 8 | | Example 9 | | Example 10 | |
|---|---|---|---|---|---|---|---|---|---|
| | | | | CMYK | RGB | CMYK | RGB | CMYK | RGB |
| Printing condition | Average value of the application amounts of the ink | High density | g/m$^2$ | 11.9 | 24.2 | 11.9 | 24.2 | 11.9 | 24.2 |
| | | Medium-high density | g/m$^2$ | 8.4 | 16.1 | 8.4 | 16.1 | 8.4 | 16.1 |
| | | Medium density | g/m$^2$ | 4.3 | 9.6 | 4.3 | 9.6 | 4.3 | 9.6 |
| | | Medium-low density | g/m$^2$ | 2.5 | 5.3 | 2.5 | 5.3 | 2.5 | 5.3 |
| | | Low density | g/m$^2$ | 0.7 | 1.7 | 0.7 | 1.7 | 0.7 | 1.7 |
| | Average value of the application amounts of the processing liquid | High density | g/m$^2$ | 2.8 | 2.8 | 2.8 | 2.8 | 2.8 | 2.8 |
| | | Medium-high density | g/m$^2$ | 2.8 | 2.8 | 2.8 | 2.8 | 2.8 | 2.8 |
| | | Medium density | g/m$^2$ | 2.7 | 2.8 | 2.7 | 2.8 | 2.7 | 2.8 |
| | | Medium-low density | g/m$^2$ | 1.9 | 2.8 | 1.9 | 2.8 | 1.9 | 2.8 |
| | | Low density | g/m$^2$ | 0.7 | 1.4 | 0.7 | 1.4 | 0.7 | 1.4 |
| | Ratio of the application amount of the processing liquid to the application amount of the ink | High density | % | 24% | 12% | 24% | 12% | 24% | 12% |
| | | Medium-high density | % | 33% | 17% | 33% | 17% | 33% | 17% |
| | | Medium density | % | 62% | 29% | 62% | 29% | 62% | 29% |
| | | Medium-low density | % | 79% | 53% | 79% | 53% | 79% | 53% |
| | | Low density | % | 100% | 84% | 100% | 84% | 100% | 84% |
| | Maximum value (%) of the deviation (absolute value) when the application amount of the processing liquid for each printing pass is compared | High density | % | 0.0 | 0.0 | 0.0 | 0.0 | 0.0 | 0.0 |
| | | Medium-high density | % | 0.0 | 0.0 | 0.0 | 0.0 | 0.0 | 0.0 |
| | | Medium density | % | 9.7 | 0.0 | 9.7 | 0.0 | 9.7 | 0.0 |
| | | Medium-low density | % | 27.3 | 0.0 | 27.3 | 0.0 | 27.3 | 0.0 |
| | | Low density | % | 50.0 | 25.0 | 50.0 | 25.0 | 50.0 | 25.0 |
| | Deviation (%) between printing passes in unit area in which the application amount of the processing liquid Pr is 0.8 g/m$^2$ or more | | | 4.9 | | 4.9 | | 4.9 | |
| | Dot arrangement of the processing liquid image | | | CMYK Image | | CMYK Image | | CMYK Image | |
| | Boundary vicinity correction between the printing areas | | | Absent | | Absent | | Absent | |
| | Landing time of the processing liquid and the ink (maximum) | | sec | 1 | | 1 | | 1 | |
| | Present or absent of the processing liquid applied to the peripheral region | | | Present | | Present* | | Present | |
| | Width of the peripheral region to which the processing liquid is applied | | mm | 0.176 | | 0.176 | | 0.141 | |
| Ink set | | | | A | | A | | A | |
| Processing liquid | | | | A | | A | | A | |
| Evaluation | Crack | | | 2 | 1 | 2 | 1 | 2 | 1 |
| | Granularity | | | 2 | 2 | 2 | 2 | 2 | 2 |
| | Color bleeding | | | 1 | 2 | 1 | 2 | 1 | 2 |
| | Quality of outline character | High density | | 2 | 1 | 1 | 1 | 1 | 1 |
| | | Medium-high density | | 2 | 1 | 1 | 1 | 1 | 1 |

-continued

| | | | | | | | |
|---|---|---|---|---|---|---|---|
| | Medium density | 2 | 2 | 1 | 1 | 1 | 1 |
| | Medium-low density | 2 | 2 | 1 | 1 | 1 | 1 |
| | Low density | 2 | 2 | 1 | 1 | 1 | 1 |

| | | | | Example 11 | | Example 12 | |
|---|---|---|---|---|---|---|---|
| | | | Unit | CMYK | RGB | CMYK | RGB |
| Printing condition | Average value of the application amounts of the ink | High density | $g/m^2$ | 11.9 | 24.2 | 11.9 | 24.2 |
| | | Medium-high density | $g/m^2$ | 8.4 | 16.1 | 8.4 | 16.1 |
| | | Medium density | $g/m^2$ | 4.3 | 9.6 | 4.3 | 9.6 |
| | | Medium-low density | $g/m^2$ | 2.5 | 5.3 | 2.5 | 5.3 |
| | | Low density | $g/m^2$ | 0.7 | 1.7 | 0.7 | 1.7 |
| | Average value of the application amounts of the processing liquid | High density | $g/m^2$ | 2.8 | 2.8 | 2.8 | 2.8 |
| | | Medium-high density | $g/m^2$ | 2.8 | 2.8 | 2.8 | 2.8 |
| | | Medium density | $g/m^2$ | 2.7 | 2.8 | 2.7 | 2.8 |
| | | Medium-low density | $g/m^2$ | 1.9 | 2.8 | 1.9 | 2.8 |
| | | Low density | $g/m^2$ | 0.7 | 1.4 | 0.7 | 1.4 |
| | Ratio of the application amount of the processing liquid to the application amount of the ink | High density | % | 24% | 12% | 24% | 12% |
| | | Medium-high density | % | 33% | 17% | 33% | 17% |
| | | Medium density | % | 62% | 29% | 62% | 29% |
| | | Medium-low density | % | 79% | 53% | 79% | 53% |
| | | Low density | % | 100% | 84% | 100% | 84% |
| | Maximum value (%) of the deviation (absolute value) when the application amount of the processing liquid for each printing pass is compared | High density | % | 0.0 | 0.0 | 0.0 | 0.0 |
| | | Medium-high density | % | 0.0 | 0.0 | 0.0 | 0.0 |
| | | Medium density | % | 9.7 | 0.0 | 9.7 | 0.0 |
| | | Medium-low density | % | 27.3 | 0.0 | 27.3 | 0.0 |
| | | Low density | % | 50.0 | 25.0 | 50.0 | 25.0 |
| | Deviation (%) between printing passes in unit area in which the application amount of the processing liquid Pr is 0.8 $g/m^2$ or more | | | 4.9 | | 4.9 | |
| | Dot arrangement of the processing liquid image | | | CMYK Image | | CMYK Image | |
| | Boundary vicinity correction between the printing areas | | | Absent | | Absent | |
| | Landing time of the processing liquid and the ink (maximum) | | sec | 1 | | 1 | |
| | Present or absent of the processing liquid applied to the peripheral region | | | Present | | Present | |
| | Width of the peripheral region to which the processing liquid is applied | | mm | 0.176 | | 0.176 | |
| Ink set | | | | A | | A | |
| Processing liquid | | | | B | | C | |
| Evaluation | Crack | | | 2 | 1 | 2 | 1 |
| | Granularity | | | 2 | 2 | 2 | 2 |
| | Color bleeding | | | 1 | 2 | 1 | 2 |
| | Quality of outline character | High density | | 1 | 1 | 1 | 1 |
| | | Medium-high density | | 1 | 1 | 1 | 1 |
| | | Medium density | | 1 | 1 | 1 | 1 |
| | | Medium-low density | | 1 | 1 | 1 | 1 |
| | | Low density | | 1 | 1 | 1 | 1 |

Present*: When the application amount of the ink is 15 $g/m^2$ or less, it is "Absent".

As can be seen from Tables III to V, in the recording method of the Examples of the present invention, the occurrence of cracks, granularity, and color bleeding was suppressed in the image formed on the recording medium with the two-liquid type inkjet recording method. It is observed that a high quality image is obtained.

Although embodiments of the present invention have been described and illustrated in detail, the disclosed embodiments are made for purposes of illustration and example only and not limitation. The scope of the present invention should be interpreted by terms of the appended claims

What is claimed is:

1. An inkjet recording method comprising the step of forming an image by applying an ink containing at least a coloring material and a processing liquid containing at least a flocculant to a surface of a recording medium by a droplet discharge device, respectively, to coalescence the ink and the processing liquid, wherein an application amount of the processing liquid is changed in accordance with an application amount of the ink for each unit area in which the image is formed, and the application amount of the processing liquid is controlled to be equal to or less than 5 $g/m^2$ in all of the unit areas; and when the image is formed in a plurality of printing passes, in the unit area in which the application amount of the processing liquid is equal to or more than 0.8 $g/m^2$, an average value of the application amounts of the processing liquid in the unit area in each printing pass is controlled so that a deviation when compared between the printing passes is within ±30%, a static surface tension of the processing liquid at 25° C. is smaller than a static surface tension of the ink, and a dynamic surface tension of the processing liquid is 35 mN/m or less at 25° C. and 50 ms.

2. The inkjet recording method described in claim 1, wherein the application amount of the processing liquid to the unit area is controlled to be 100% or less of the application amount of the ink in all the unit areas where the image are formed, and the application amount of the processing liquid to the unit area is controlled to be 45% or less of the application amount of the ink when the application amount of the ink in the unit areas is equal to or more than 9 $g/m^2$.

3. The inkjet recording method described in claim 1, wherein the inkjet recording method is controlled so that the processing liquid is not applied to the unit area when the application amount of the ink is equal to or less than 1.0 $g/m^2$ in the unit area where the image is formed.

4. The inkjet recording method described in claim 1, wherein the processing liquid is applied by an error diffusion method.

5. The inkjet recording method described in claim 1, wherein the formation of an image on the surface of the recording medium is performed so that print areas corresponding to a print width of the droplet discharge device are arranged in parallel, and the application amount of the processing liquid in a vicinity of a boundary between the print areas is relatively increased.

6. The inkjet recording method described in claim 1, wherein a landing time of the processing liquid and a landing time of the ink are 0.6 seconds or less, respectively.

7. The inkjet recording method described in claim 1, wherein the processing liquid is applied to an image forming region on which the image is formed and a peripheral region of the image forming region, and the application amount of the processing liquid to the peripheral region of the image forming region is controlled to be the same as the application amount of the processing liquid at an end portion of the image forming region.

8. The inkjet recording method described in claim 7, wherein the inkjet recording method is controlled so that the processing liquid is not applied to the peripheral region of the image forming region when the application amount of the ink at the end portion of the image forming region is equal to or less than 15 $g/m^2$.

9. The inkjet recording method described in claim 7, wherein the peripheral region of the image forming region is a region of 0.030 to 0.150 mm outside an outer periphery starting from the outer periphery of the image forming region.

10. The inkjet recording method described in claim 1, wherein the processing liquid contains a polyvalent metal salt or a solution cationic polymer as the flocculant, and the processing liquid does not contain resin fine particles.

11. The inkjet recording method described in claim 1, wherein the inkjet recording method is controlled so that the application amount of the processing liquid is substantially proportional to the application amount of the ink when the application amount of the ink is equal to or more than 1.0 $g/m^2$ and equal to or less than 5.0 $g/m^2$ in the unit area where the image is formed.

12. An inkjet recording apparatus using an ink containing at least a coloring material and a processing liquid containing at least a flocculant, comprising a droplet discharge device having one or more discharge ports for discharging the ink and one or more discharge ports for discharging the processing liquid for forming an image by applying droplets of the ink and droplets of the processing liquid to a surface of a recording medium from the droplet discharge device to coalescence the droplets of the ink and the droplets of the processing liquid, wherein an application amount of the processing liquid is changed in accordance with an application amount of the ink for each unit area in which the image is formed, and the application amount of the processing liquid is controlled to be equal to or less than 5 $g/m^2$ in all of the unit areas, and when the image is formed in a plurality of printing passes, in the unit area in which the application amount of the processing liquid is equal to or more than 0.8 $g/m^2$, an average value of the application amounts of the processing liquid in the unit area in each printing pass is controlled so that a deviation when compared between the printing passes is within ±30%, a static surface tension of the processing liquid at 25° C. is smaller than a static surface tension of the ink, and a dynamic surface tension of the processing liquid is 35 mN/m or less at 25° C. and 50 ms.

13. The inkjet recording apparatus described in claim 12, wherein the application amount of the processing liquid to the unit area on which the image is formed is controlled to be 100% or less of the application amount of the ink, and when the application amount of the ink to the unit area is 9 $g/m^2$ or more, the application amount of the processing liquid to the unit area is controlled to be 45% or less of the application amount of the ink.

14. The inkjet recording apparatus described in claim 12, wherein the processing liquid is applied to the image forming region on which the image is formed and the peripheral region of the image forming region, and the application amount of the processing liquid to the peripheral region of the image forming region is controlled to be the same as the application amount of the processing liquid at an end portion of the image forming region.

* * * * *